US005478707A

United States Patent [19]

Asami

[11] Patent Number: 5,478,707

[45] Date of Patent: Dec. 26, 1995

[54] SILVER HALIDE PHOTOGRAPHIC LIGHT-SENSITIVE MATERIAL

[75] Inventor: Masahiro Asami, Kanagawa, Japan

[73] Assignee: Fuji Photo Film Co., Ltd., Kanagawa, Japan

[21] Appl. No.: 240,619

[22] Filed: May 11, 1994

[30] Foreign Application Priority Data

May 12, 1993 [JP] Japan ..... 5-132350

[51] Int. Cl.[6] ..... G03C 1/815; G03C 1/005; G03C 1/09

[52] U.S. Cl. ..... 430/504; 430/567; 430/600; 430/607; 430/611; 430/613; 430/931

[58] Field of Search ..... 430/567, 569, 430/504, 600, 607, 611, 613, 931, 359, 362

[56] References Cited

U.S. PATENT DOCUMENTS

| | | | |
|---|---|---|---|
| 4,116,697 | 9/1978 | Bigelow | 430/600 |
| 4,983,508 | 1/1991 | Ishiguro et al. | 430/569 |
| 5,021,328 | 6/1991 | Takahashi | 430/505 |

FOREIGN PATENT DOCUMENTS

| | | | |
|---|---|---|---|
| 3-212639 | 9/1991 | Japan | 430/569 |

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

There is disclosed a silver halide photographic light-sensitive which is capable of providing a rapid processing as well as a high sensitivity and in which a change in an aging time in exposing through processing provides less performance fluctuation and therefore an excellent stability. The silver halide photographic light-sensitive material comprises a support and provided thereon at least one light-sensitive silver halide emulsion layer and at least one non-light-sensitive layer, wherein at least one of the above light-sensitive emulsion layers contains a silver halide emulsion grain which comprises silver bromochloride having a silver chloride content of 90% or more or silver chloride each containing substantially no silver iodide and in which 50% or more of a grain surface consists of a (111) plane; and further, at least one of the non-light-sensitive layers contains a compound represented by the following Formula (I):

(I)

wherein X represents a hydrogen atom, a hydroxyl group, an amino group, or a sulfonamido group; $R^{11}$ and $R^{12}$ each represent the same group as that defined for X, an alkyl group, an aryl group, an amido group, a ureido group, an alkylthio group, an arylthio group, an alkoxy group, or an aryloxy group, and $R^{11}$ and $R^{12}$ may cooperate to form a carbon ring or a heterocyle; when X is a hydrogen atom, $R^{11}$ represents a hydroxyl group, an amino group, or a sulfonamido group; $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group; and, the compound represented by Formula (I) has a molecular weight of 390 or more.

14 Claims, No Drawings

SILVER HALIDE PHOTOGRAPHIC LIGHT-SENSITIVE MATERIAL

FIELD OF THE INVENTION

The present invention relates to a silver halide photographic light-sensitive material, more specifically to a silver halide photographic light-sensitive material which excels in rapid processability and has a high sensitivity, low fogging and excellent performance stability in aging after exposure.

BACKGROUND OF THE INVENTION

A color photograph which has widely been popularized at present has progressed to the extent that it can be obtained more quickly and easily in any place by progress of a light-sensitive material itself and a development processing technique. In particular, in a color print field, a centralized processing system at a production point called a color laboratory, where a high speed printer for a large volume production and a large-scale processing equipment are installed, and a development in a dispersed processing system using a small sized printer processor called "mini labo" installed in a store allow a production according to various purposes can be carried out.

In recent years, commercialization of a light-sensitive material using a high silver chloride emulsion and the processing process therefore, has greatly advanced rapidity in processing. Researches on raising the performances of such the high silver chloride emulsion having an excellent rapid processing have been energetically carried out. It has so far been known that the high silver chloride emulsion is liable to have a defect that it is difficult to provide a high sensitivity or liable to fog.

Meanwhile, it is known that a silver halide fine crystal grain contained in the high silver chloride emulsion is usually easy to form cube or tetradecahedron which is rich in a (100) plane, and almost all of the emulsions used in the techniques described above contain cubic grains.

To the contrary, recently a technique for carrying out a grain formation under presence of a specific compound to form the grains in which 50% or more of an outer surface consists of a (111) plane is disclosed in, for example, JP-A-4-283742 (the term "JP-A" as used herein means an unexamined published Japanese patent application), and it is reported that such grains have a high sensitivity and a low fog.

According to the procedure disclosed above, an emulsion comprising high silver chloride grains in which 50% or more of an outer surface consists of the (111) plane has been prepared and a color photographic paper has been produced using the emulsion in order to obtain a high silver chloride emulsion having a high sensitivity and a low fog. The color photographic paper thus obtained, however, have generated various problems in a practical application. That is, it has been found that while such an emulsion provides a high sensitivity, it has so-called latent image fading that a developed density is lowered by aging after exposing and before processing.

In the production of a color print using the color photographic paper, a stabilization in quality of a print obtained as well as rapid processability has always been required to improve a productive efficiency. Accordingly, the latent image fading in a printing process makes it difficult to keep a print quality constant. Considering the actual condition of a market which has already been described, this problem on a performance stability will become a serious defect.

In other words, the provision of a high sensitivity and the stabilization of a latent image are very important subjects in providing a light-sensitive material with which a print having a high quality can be produced in a high efficiency, and the development of a technique which can achieve them at the same time has been desired.

SUMMARY OF THE INVENTION

As is apparent from the matters described above, the object of the present invention is to provide a silver halide photographic light-sensitive material which is capable of a rapid processing and has a high sensitivity and in which a change in an aging time after exposing and before processing provides less performance fluctuation and an excellent stability.

It has been clarified that the above object of the present invention can be achieved by a silver halide photographic light-sensitive material comprising a support and provided thereon at least one light-sensitive silver halide emulsion layer and at least one non-light-sensitive layer, wherein at least one of the above light-sensitive emulsion layers contains a silver halide emulsion grain which comprises silver bromochloride having a silver chloride content of 90% or more or silver chloride each containing substantially no silver iodide and in which 50% or more of a grain surface consists of a (111) plane; and further, at least one of the non-light-sensitive layers contains a compound represented by the following Formula (I):

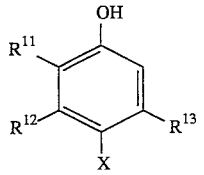

(I)

wherein X represents a hydrogen atom, a hydroxyl group, an amino group, or a sulfonamido group; $R^{11}$ and $R^{12}$ each represent the same group as that defined for X, an alkyl group, an aryl group, an amido group, a ureido group, an alkylthio group, an arylthio group, an alkoxy group, or an aryloxy group, and $R^{11}$ may form a carbon ring or a heterocyle together with $R^{12}$; when X is a hydrogen atom, $R^{11}$ represents a hydroxyl group, an amino group, or a sulfonamido group; $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group; and further, the compound represented by Formula (I) has a molecular weight of 390 or more.

Further, the above object of the present invention can be achieved by a silver halide photographic light-sensitive material comprising a support and provided thereon at least one light-sensitive silver halide emulsion layer and at least one light-insensitive layer, wherein at least one of the above light-sensitive emulsion layers contains a silver halide emulsion grain which is formed under the presence of at least one of the compounds represented by the following Formula (II), (III), (IV), or (V) and comprises silver bromochloride having a silver chloride content of 90% or more or silver chloride each containing substantially no silver iodide and in which 50 % or more of a grain surface consists of a (111) plane; and further, at least one of the non-light-sensitive layers contains the compound represented by the above Formula (I):

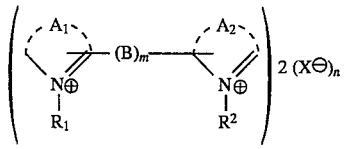

(II)

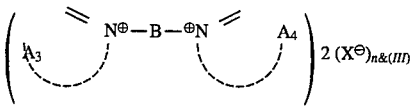

wherein $A_1$, $A_2$, $A_3$, and $A_4$ represent a group of non-metal atoms necessary to complete a nitrogen-containing heterocycle and may be the same or different each other; B represents a divalent linkage group; m represents 0 or 1; $R_1$ and $R_2$ each represent an alkyl group; X represents an anion; and n represents 0 or 1 and when an intramolecular salt is formed, n is 0:

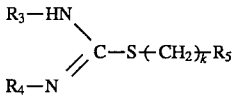

(IV)

wherein $R_3$ and $R_4$ each represent a hydrogen atom, an aryl group, or an aralkyl group, and $R_3$ and $R_4$ may be the same or different; $R_5$ represents an amino group, a sulfonic acid group, or a carboxyl group; and k represents an integer of 1 to 5:

$$X—L^1—(S—L^2)_p—X._qZ \quad (V)$$

wherein X represents an unsubstitited or alkylsubstituted amino group, a quaternary alkylammonium group or a carboxyl group; $L^1$ and $L^2$ each represent a divalent organic group composed of at least one of the groups of an alkylene group, an alkenylene group, —$SO_2$—, —SO—, —O—, —CO—, and —N(R)—, in which R represents a hydrogen atom, an alkyl group, an aryl group or —$L^3$—$(S—L^4)_p$—X, and $L^3$ and $L^4$ each represent an alkylene group, an alkenylene group, —$SO_2$—, —SO—, —O— and —CO—; p represents an integer of 1 to 5; q represents an integer of 0 to 3 and is the same as a number of the quaternary alkylammonium group; Z represents an anion; and when two or more of —S—$L^2$ group are present in formula (V), two or more of $L^2$ may be the same or different each other and two groups represented by X in formula (V) may be the same or different each other.

DETAILED DESCRIPTION OF THE INVENTION

Formula (I) will be explained in more details.

X represents a hydrogen atom, a hydroxyl group, an amino group (a carbon number of 0 to 20, for example, amino, diethylamino, and dioctylamino), or a sulfonamido group (a carbon number of 1 to 20, for example, methanesulfonamide, benzenesulfonamide, and 4-eicosiloxybenzenesulfonamido). $R^{11}$ and $R^{12}$ each represent the same group as that defined for X, an alkyl group (a carbon number of 1 to 20, for example, methyl, t-butyl, hexadecyl, and 1-methyltridecyl), an aryl group (a carbon number of 6 to 20, for example, phenyl, p-tolyl, and 4-dodecylphenyl), an amido group (a carbon number of 1 to 20, for example, acetoamido, benzoylamino, and 2-hexyldecanoylamino), a ureido group (a carbon number of 0 to 20, for example, N,N-dimethylureido and N-hexadecylureido), an alkylthio group (a carbon number of 1 to 20, for example, methylthio and decylthio), an arylthio group (a carbon number of 6 to 20, for example, phenylthio and 4-t-octylphenylthio), an alkoxy group (a carbon number of 1 to 20, for example, methoxy, butoxy and tetradecyloxy), or an aryloxy group (a carbon number of 6 to 20, for example, phenoxy and 4-methoxyphenoxy), and $R^{11}$ and $R^{12}$ may cooperate to form a carbon ring (for example, a naphthalene ring) or a heterocyle (for example, a carbostyryl ring). When X is a hydrogen atom, $R^{11}$ represents a hydroxyl group, an amino group, or a sulfonamido group. $R^{13}$ represents a hydrogen atom, a halogen atom (for example, fluorine, chlorine and bromine), a sulfo group, a carboxyl group, an alkyl group (a carbon number of 1 to 20, for example, methyl, t-butyl, hexadecyl, and 1-methyltridecyl), an acyl group (a carbon number of 2 to 20, for example, acetyl, benzoyl, and octadecanoyl), an oxycarbonyl group (a carbon number of 2 to 20, for example, methoxycarbonyl, phenoxycarbonyl, and 2-ethylhexyloxycarbonyl), a carbamoyl group (a carbon number of 1 to 20, for example, N-butylcarbamoyl and N,N-dioctylcarbamoyl), a sulfonyl group (a carbon number of 1 to 20, for example, methanesulfonyl, benzenesulfonyl, and dodecylbenzenesulfonyl), or a sulfamoyl group (a carbon number of 0 to 20, for example, N,N-diethylsulfamoyl and N-octadecylsulfamoyl). The compound represented by Formula (I) has a molecular weight of 390 or more.

The substituents X, $R^{11}$, $R^{12}$ and $R^{13}$ may further be substituted with the other substituents. There can be enumerated as the substituents for further substituting, for example, an alkyl group, an aryl group, an amido group, an alkylthio group, an arylthio group, an alkoxy group, an aryloxy group, an oxycarbonyl group, a carbamoyl group, an acyloxy group, an acyl group, a sulfonamido group, a sulfamoyl group, a sulfonyl group, a heterocyclic group, a hydroxyl group, a halogen atom, a cyano group, a nitro group, a sulfo group, a carboxyl group, and an amino group. However, they are not limited thereto.

Of the compounds represented by Formula (I), those represented by the following Formula (VI) are preferred:

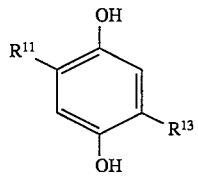

(VI)

wherein $R^{11}$ and $R^{13}$ are the same as those defined in Formula (I), and the compound has a molecular weight of 390 or more.

In Formulas (I) and (VI), those preferred as X, $R^{11}$, $R^{12}$ and $R^{13}$ are as follows. Preferred as X is a hydroxyl group. Preferred as $R^{11}$ is an alkyl group, an amido group, an alkylthio group, or an alkoxy group. Preferred as $R^{12}$ is a hydrogen group.

Preferred as $R^{13}$ is a hydrogen group, an alkyl group, a halogen atom, a carbamoyl group, or a sulfonyl group. The compounds of these formulas have a molecular weight of preferably 430 or more, further preferably 500 or more.

The concrete examples of the compounds represented by Formulas (I) and (VI) are shown below but the present invention is not limited thereto.

M.W. represents a molecular weight.

SV-1
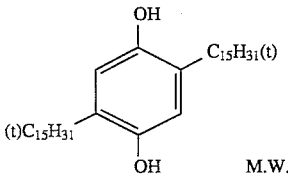
M.W. = 530.9
SV-2
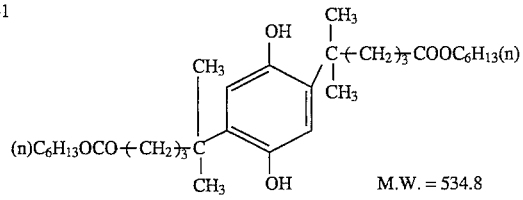
M.W. = 534.8
SV-3
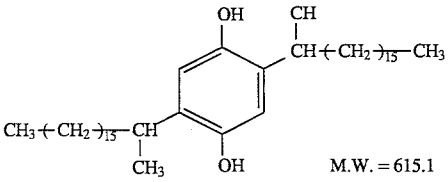
M.W. = 615.1
SV-4
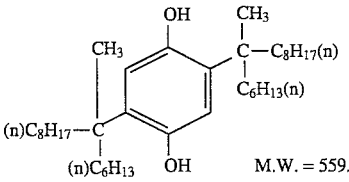
M.W. = 559.0
SV-5
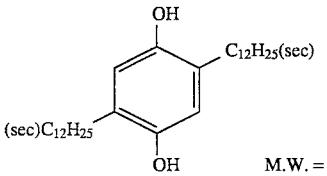
M.W. = 446.8
SV-6
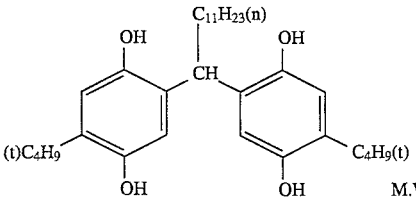
M.W. = 498.8
SV-7
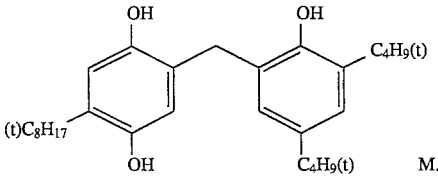
M.W. = 440.7
SV-8
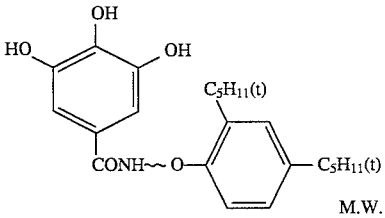
M.W. = 443.6
SV-9
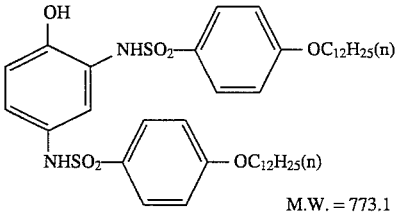
M.W. = 773.1
SV-10
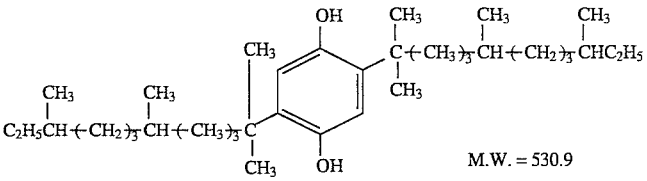
M.W. = 530.9
SV-11
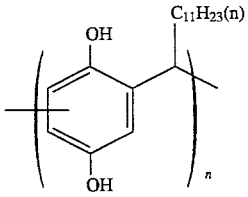
mean molecular weight: about 3,000
SV-12
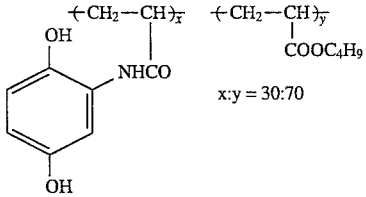
x:y = 30:70
mean molecular weight: about 3,000

-continued
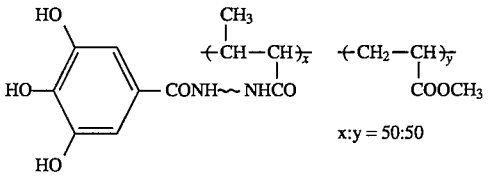
mean molecular weight: about 10,000
SV-13
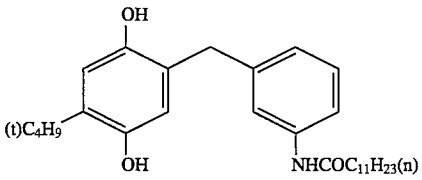
M.W. = 453.6
SV-14
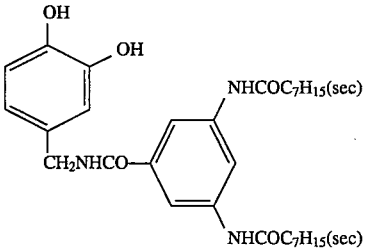
M.W. = 525.7
SV-15
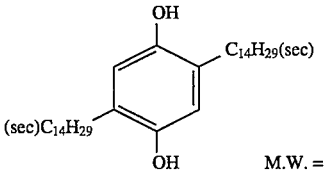
M.W. = 502.8
SV-16
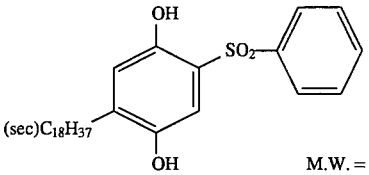
M.W. = 502.8
SV-17
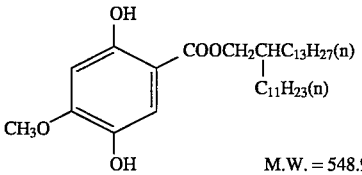
M.W. = 548.9
SV-18
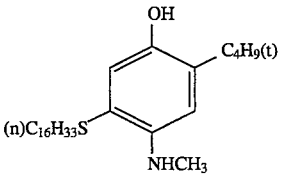
M.W. = 435.8
SV-19
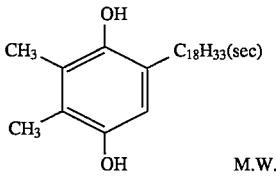
M.W. = 390.7
SV-20
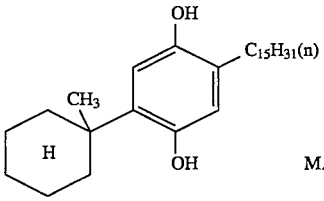
M.W. = 416.7
SV-21
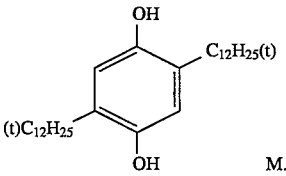
M.W. = 446.8
SV-22
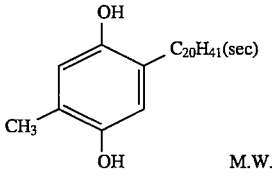
M.W. = 404.7
SV-23
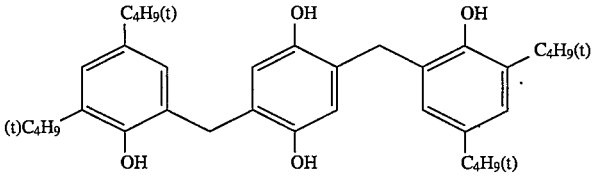
M.W. = 546.8
SV-24

-continued

SV-25

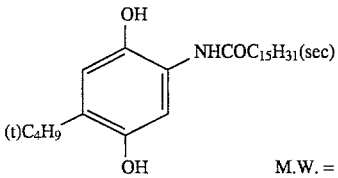

M.W. = 419.7

SV-26

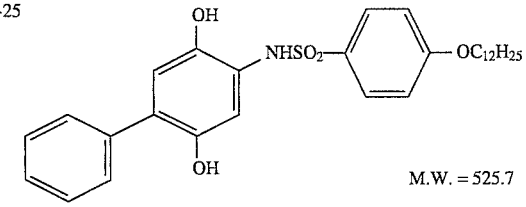

M.W. = 525.7

SV-27

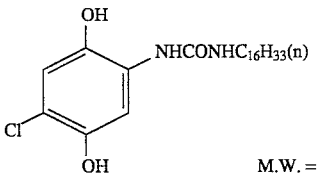

M.W. = 422.0

SV-28

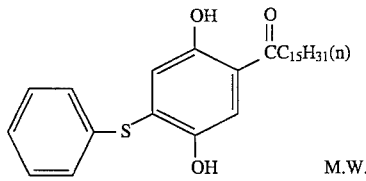

M.W. = 456.6

SV-29

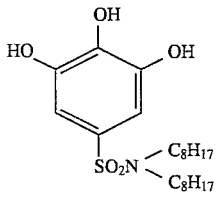

M.W. = 429.6

SV-30

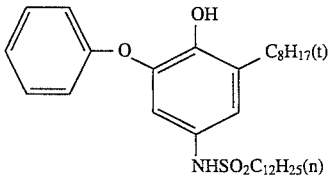

M.W. = 545.8

The compounds of Formulas (I) and (VI) according to the present invention can be synthesized according to the processes described in JP-B-51-12250 (the term "JP-B" as used herein means an examined Japanese patent publication) and 61-13748, JP-A-57-22237, 58-21249, 58-156932, and 59-5247.

The amounts used of these compounds of Formula (I) are spread over a wide range according to the purposes, and they are usually used in the range of $1\times10^{-5}$ to $10^{-2}$ mole/$m^2$.

Well known techniques can be applied for the incorporation of these compounds into a light-sensitive material. Usually, they can be added by an oil-in-water dispersing process known as an oil protect process, wherein they are dissolved in a solvent and then emulsified to be dispersed in a gelatin aqueous solution containing a surface active agent. Alternatively, water or a gelatin aqueous solution may be added to the solutions of these compounds containing the surface active agents to prepare the oil-in-water dispersions accompanying with a phase inversion. In the case where these compounds are liquid at a normal temperature, they can be added so as to be used as an in-water dispersion without using a high boiling organic solvent.

These compounds can be added to any layer constituting a light-sensitive material.

A halogen composition of the silver halide grains according to the present invention comprises silver bromochloride in which 80 mole % or more of the whole silver halide constituting the silver halide grains is silver chloride or silver chloride, which does not substantially contain silver iodide. The silver chloride content is preferably 90 mole % or more, further preferably 95 mole % or more. The most preferred halogen composition of the silver halide grains is silver bromochloride in which 99 mole % or more of the whole silver halide constituting the silver halide grains is silver chloride or silver chloride, which does not substantially contain silver iodide. Herein, "does not substantially contain silver iodide" means that a silver iodide content is 1.0 mole % or less, most preferably 0 mole %.

The compounds represented by Formulas (II) and (III) will be explained below in further details.

$A_1$, $A_2$, $A_3$, and $A_4$ represent a group of non-metal atoms necessary to complete a nitrogen-containing heterocycle and in addition to the nitrogen atom, an oxygen atom, a nitrogen atom and/or a sulfur atom may be contained as a hetero atom. The heterocycle may further be condensed with a benzene ring. The heterocycles constituted by $A_1$, $A_2$, $A_3$, and $A_4$ may have the substituents and they may be the same as or different from each other. The example of the substituent includes an alkyl group, an aryl group, an aralkyl group, an alkenyl group, a halogen atom, an acyl group, an alkoxycarbonyl group, an aryloxycarbonyl group, a sulfo group, a carboxy group, a hydroxy group, an alkoxy group, an aryloxy group, an amido group, a sulfamoyl group, a carbamoyl group, a ureido group, an amino group, a sulfonyl group, a cyano group, a nitro group, a mercapto group, an alkylthio group, and an arylthio group. There can be enumerated as the preferred example of the heterocycle, a 5- to 6-memebered ring such as a pyridine ring, an imidazole ring, a thiazole ring, an oxazole ring, a pyridine ring, and a pyrimidine ring. The pyridine ring can be enumerated as the further preferred example. The substituents for the $A_1$, $A_2$, $A_3$ and $A_4$ each may have a further substituent thereon.

B represents a divalent linkage group. There can be enumerated as the divalent linkage group, for example, alkylene, arylene, alkenylene, —$SO_2$—, —SO—, —O—, —S—, —CO—, and —$NR_3$— ($R_3$ represents an alkyl group, an aryl group or a hydrogen atom), or those constituted by combining them. These linkage groups may further be substituted with a substituent such as a hydroxyl group. Alkylene and alkenylene are enumerated as the preferred example of B.

$R_1$ and $R_2$ represent preferably an alkyl group having a carbon number of 1 or more and 20 or less. $R_1$ and $R_2$ may be the same or different.

The alkyl group includes the substituted and unsubstituted alkyl groups, and the substituents therefor are the same as those enumerated as the substituents for the nitrogen-containing heterocycles completed by $A_1$, $A_2$, $A_3$, and $A_4$.

The further preferred example of $R_1$ and $R_2$ each is an alkyl group having a carbon number of 4 to 10. The more further preferred example is the alkyl group substituted with a substituted or non-substituted aryl group.

X represents an anion and there can be enumerated as the concrete example thereof, a chloride ion, a bromide ion, an iodide ion, a nitric acid ion, a sulfuric acid ion, p-toluenesulfonato, and oxalato. n represents 0 or 1, and in the case where an intramolecular salt is formed, n is 0.

The compounds represented by Formula (II) and (III) can be synthesized by the process described in JP-A-2-32.

The concrete examples of the compounds represented by Formulas (II) and (III) are enumerated below but the present invention is not limited only thereto. In the examples of the compounds of Formula (II) and (III), the compounds of (II-21), (II-22), (II-23), (II-24) and (II-26) belong to those of Formula (III).

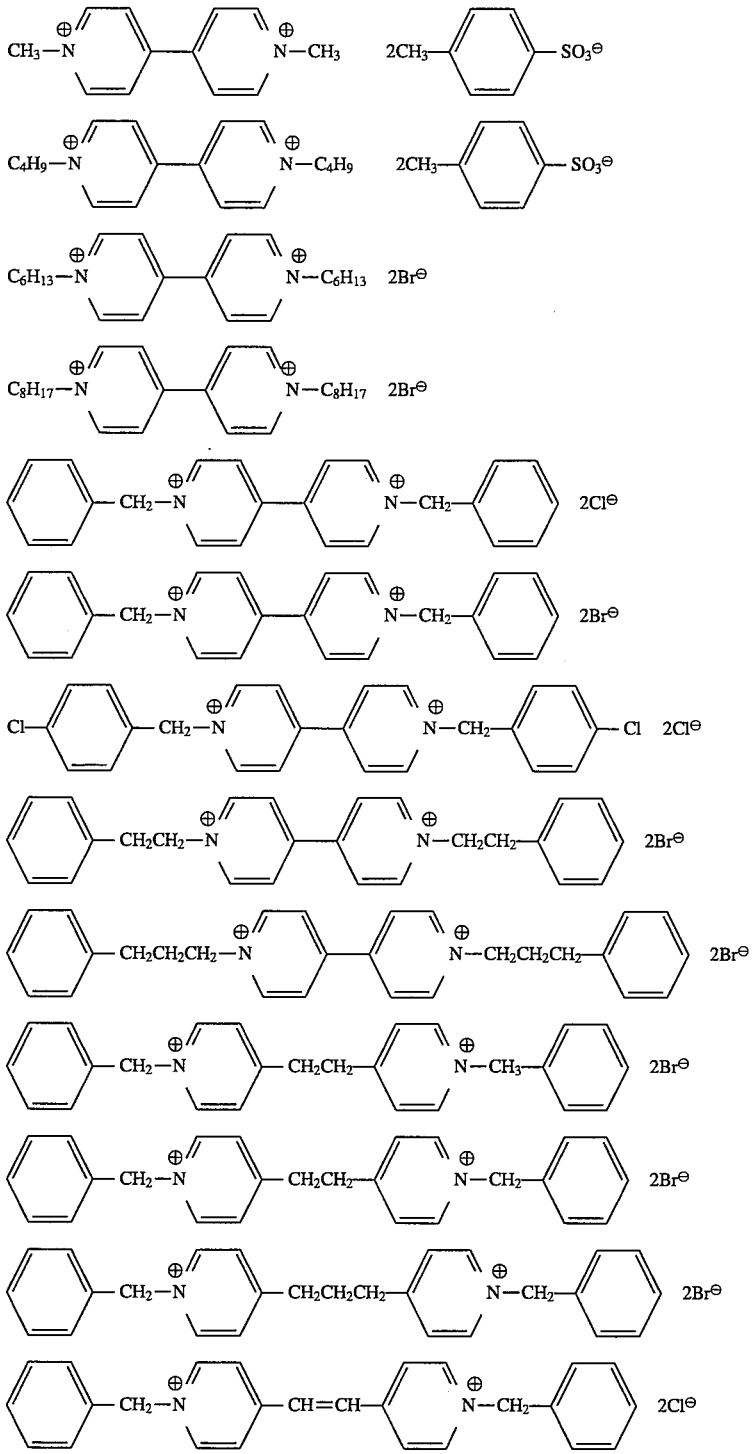

II-1

II-2

II-3

II-4

II-5

II-6

II-7

II-8

II-9

II-10

II-11

II-12

II-13

-continued
II-14
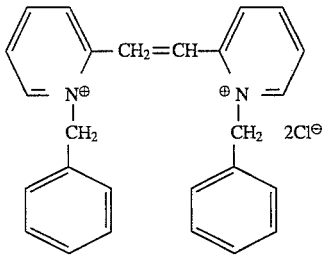
II-15
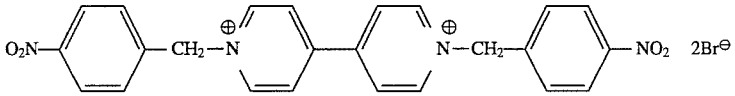
II-16
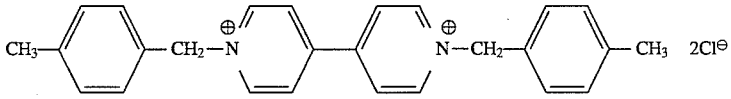
II-17
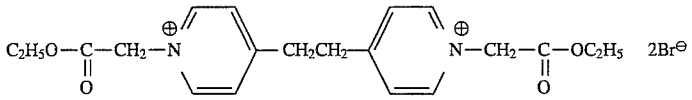
II-18
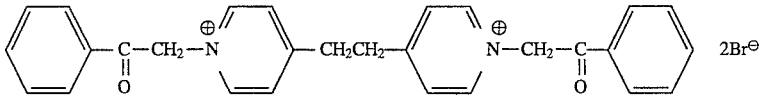
II-19
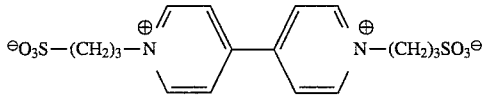
II-20
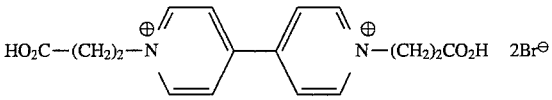
II-21
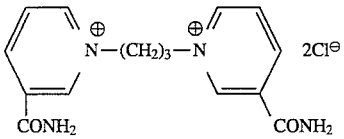
II-22
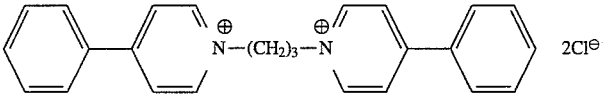
II-23
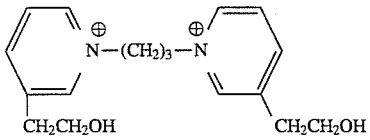
II-24
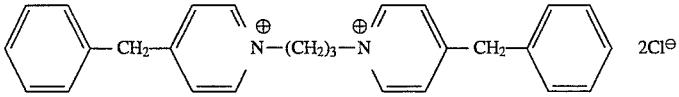
II-25
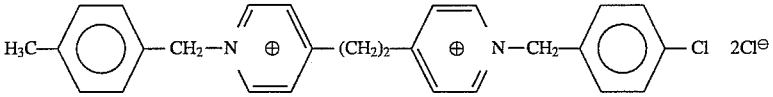

-continued

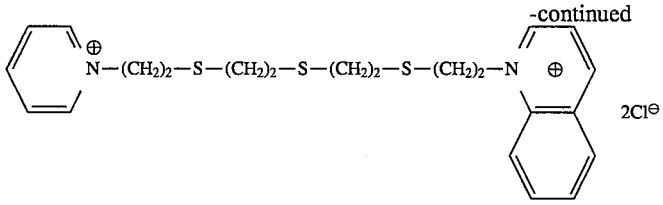

II-26

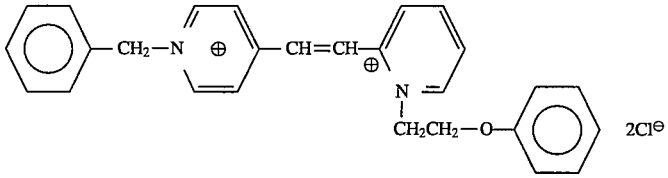

II-27

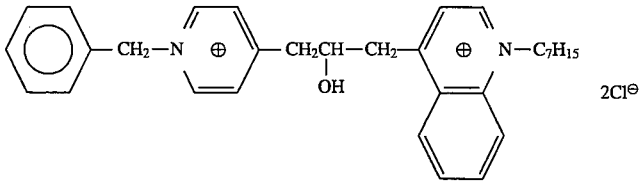

II-28

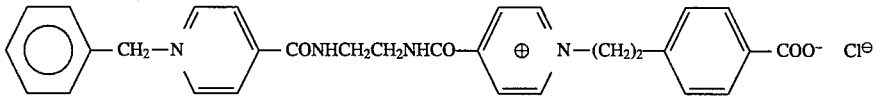

II-31

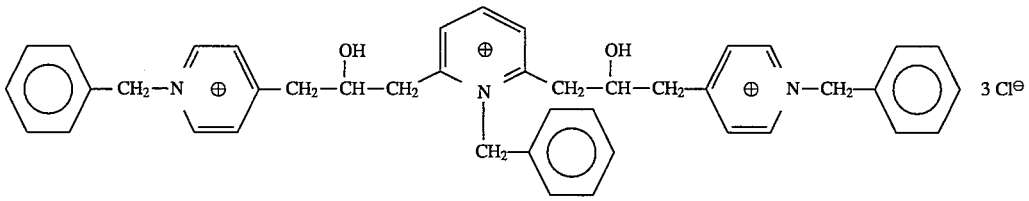

II-31

The compound represented by Formula (IV) is explained in detail.

$R_3$ and $R_4$ each represent a hydrogen atom, an aryl group, or an aralkyl group and may further be substituted with a substituent. $R_3$ and $R_4$ may be the same or different. A substituent for a phenyl group moiety in the aryl group and the aralkyl group includes an alkyl group (methyl and ethyl), a hydroxyl group, a carboxyl group, and a halogen atom (Cl and Br). $R_3$ and $R_4$ each are preferably a hydrogen atom or a phenyl group.

$R_5$ represents an amino group, a sulfonic acid group, or a carboxyl group. The amino group may be substituted with an alkyl group and the alkyl group includes an alkyl group having a carbon number of 1 to 5. An unsubstituted amino group and a methyl-substituted amino group are preferred. k represents an integer of 1 to 5. It is preferably 2 to 3.

The compound used in the present invention represented by Formula (IV) can be obtained by reacting a corresponding halide with a thiourea derivative. It can be synthesized by the processes described in, for example, R. O. Clinton et al, J. Am. Chem. Soc., 70, 950 (1948) and D. G. Doherty et al, J. Am. Chem. Soc., 79, 5670 (1957). Further, it can be synthesized as well by the process described in Japanese Patent Application 3-70398.

Next, the concrete examples of the compound represented by Formula (IV) are enumerated but are not limited thereto.

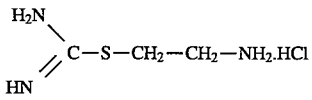

IV-(1)

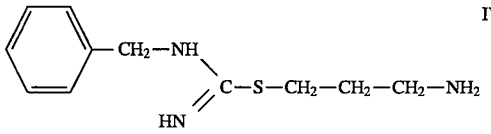

IV-(2)

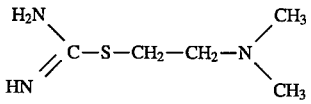

IV-(3)

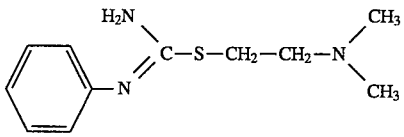

IV-(4)

-continued

IV-(5)

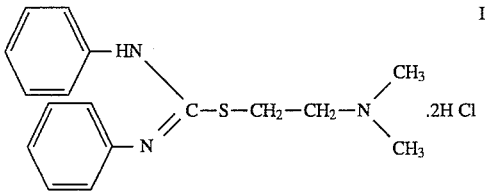

IV-(6)

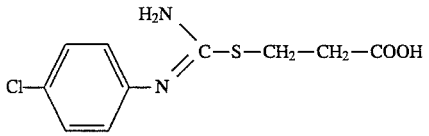

IV-(7)

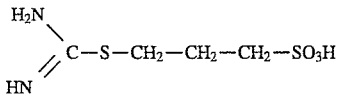

IV-(8)

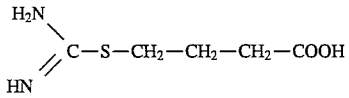

Next, Formula (V) is explained.

An amino group which may be substituted with an alkyl group and an alkyl group in a quaternary alkyl ammonium group in X may further have the substituents. There can be enumerated as the substituent, an alkylthio group, a hydroxyl group, a carboxyl group, a sulfonic acid group, a phosphono group, and a halogen atom. An amino group which may be substituted with an unsubstituted or substituted alkyl group can be enumerated as the preferred example of X. A carbon number of the alkyl group is preferably 1 to 3. The alkylene groups represented by $L^1$, $L^2$, $L^3$, and $L^4$ may further be substituted, and there can be enumerated as the substituent for the alkylene group, a hydroxyl group, a carboxyl group, a sulfonic acid group, a phosphono group, and a halogen atom. There can be enumerated as the preferred examples of $L^1$ and $L^2$, a divalent organic group constituted singly from an alkylene group which may be substituted, —O—, —CO—, —N(R)—, or those constituted by combining them.

There can be enumerated as the more preferred examples of $L^1$ and $L^2$, a divalent organic group constituted singly from an alkylene group which may be substituted, —N(R)— [provided that R represents a hydrogen atom, an alkyl group, or $—L^3—(S-L^4)_p—X$, wherein $L^3$ and $L^4$ are preferably an alkylene group], or those constituted by combining them.

The alkylene group which may be substituted has preferably a carbon number of 1 to 5. p is preferably 1 to 4. The anion represented by Z represents, for example, a chloride ion, a bromide ion, an iodide ion, a nitric acid ion, a sulfonic acid ion, p-toluenesulfonato, and oxalato.

The compounds represented by Formula (V) is known in JP-A-3-212639.

The concrete examples of the compound represented by Formula (V) are listed below but are not limited thereto.

V-(1)

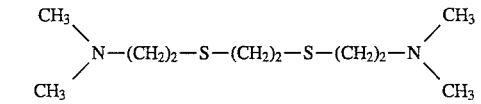

V-(2)

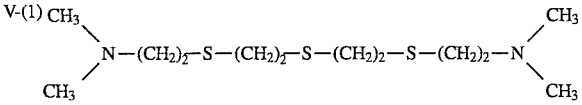

V-(3)

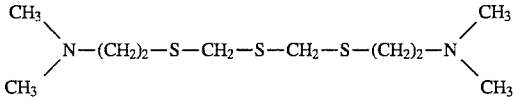

V-(4)

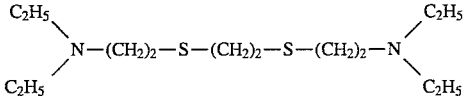

V-(5)

V-(6)

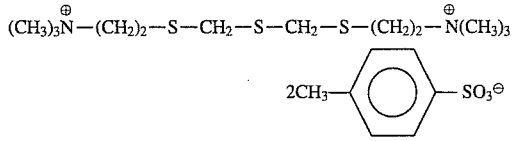

V-(7)

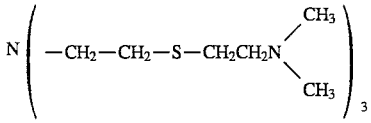

V-(8)

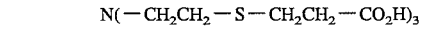

V-(9)

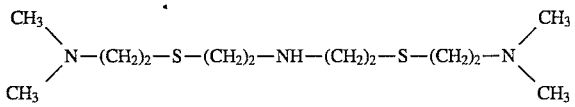

V-(10)

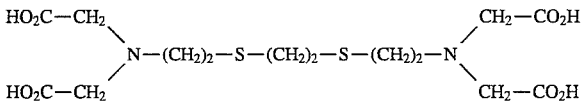

V-(11)

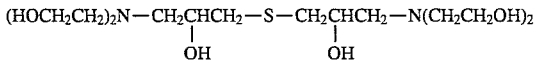

-continued $$(HO_3S-CH_2CH_2)_2N-(CH_2)_2-S-(CH_2)_2-S-(CH_2)_2-N(CH_2CH_2SO_3H)_2 \quad \text{V-(12)}$$

$$(H_2O_3P-CH_2)_2N-(CH_2)_2-S-(CH_2)_2-S-(CH_2)_2-N(CH_2PO_3H_2)_2 \quad \text{V-(13)}$$

$$CH_3NH-(CH_2)_2-S-CH_2-S-CH_2-S-(CH_2)_2NHCH_3 \quad \text{V-(14)}$$

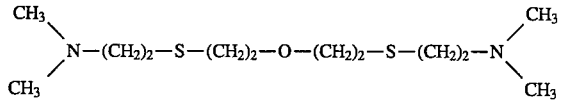

V-(15)

$$HO_2C-CH_2NHCO-CH_2CH_2-S-CH_2CH_2-CONH-CH_2-CO_2H \quad \text{V-(16)}$$

$$HO_2C-CH_2SO_2-(CH_2)_2-S-(CH_2)_2-S-(CH_2)_2-SO_2CH_2-CO_2H \quad \text{V-(17)}$$

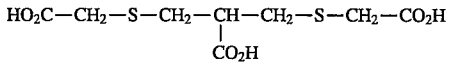

V-(18)

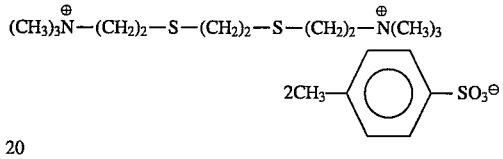

V-(19)

The addition timing of the compound represented by Formula (II) or (III), the compound represented by Formula (IV) or the compound represented by (V) may be any time as long as it is before finishing a grain formation. They are added preferably before starting the grain formation. The addition amount of the above compounds is preferably $1\times10^{-6}$ to $1\times10^{-1}$ mole, further preferably $1\times10^{-5}$ to $1\times10^{-2}$ mole per mole of silver halide.

Of the compound represented by Formula (II) or (III), the compound represented by Formula (IV) or the compound represented by (V), the compound represented by Formula (II) or (III) and the compound represented by Formula (IV) are preferred and the compound represented by Formula (II) or (III) is most preferred in terms of materializing the effects of the present invention.

In the silver halide emulsion grains constituting the silver halide emulsion of the present invention, 50% or more based on a grain surface area is composed of a (111) plane. The ratio of the (111) plane to the surface area is more preferably 80% or more, further preferably 90% or more, and most preferably 95% or more. The ratio of the (111) plane to the surface area is defined in the following manner. That is, the silver halide grains are photographed with an electron microscope (a grain number is at least 50 or more), and it is determined by obtaining a ratio of a surface area consisting of the (111) plane to the sum of the surface area of the whole grains. It can be judged geometrically or crystalographically whether or not some plane is composed of the (111) plane.

The silver halide emulsion of the present invention may be used singly or can be mixed with an emulsion falling out of the present invention. In the case where the silver halide emulsion of the present invention is mixed with other emulsions, 10% or more, preferably 20% or more, further preferably 50% or more in terms of weight based on the whole silver halide contained in the layer is preferably the silver halide emulsion of the present invention.

The halogen composition of the emulsion may be different or equivalent between grains. The use of the emulsion containing the grains each having the same composition can readily homogenize the quality of each of the grains. With respect to the halogen composition distribution in the inside of the silver halide emulsion grain, there can suitably be selected and used the grains of a so-called homogeneous type structure in which the composition is the same at any part of the silver halide grain, the grains of a so-called laminating type structure in which a core present in the inside of the silver halide grain and a shell (one layer or plural layers) surrounding it have the different halogen compositions, or the grains of a structure in which there are present the portions having the different halogen compositions in the inside or on the surface of the grain in the form of a non-layer (the structure in which the portions of the different compositions are conjugated at an edge or a corner or on a surface of the grain in the case where they are present on the surface of the grain). The use of either of the latter two rather than the grains of the homogeneous type structure is advantageous for obtaining a high sensitivity and is preferred as well from the viewpoint of a pressure resistance performance. In the case where the silver halide grains have the above structures, the boundary at the portions having the different halogen compositions may have a distinct boundary or an indistinct boundary in which a mixed crystal is formed according to the composition difference, or a structure in which a continuous structural change is allowed to positively be provided.

In the high silver chloride emulsion of the present invention, preferred is an emulsion having a structure in which a silver bromide-localizing phase (silver bromide rich phase) is present in the form of the layer or non-layer as mentioned above in the inside of a silver halide grain and/or on the surface thereof. The halogen composition in the above localizing phase is preferably at least 10 mole %, more preferably exceeding 20 mole % in terms of a silver bromide content. These localizing phases can be present in a grain inside, at an edge or a corner or on a plane of a grain surface. The localizing phase epitaxially grown at the corner portion of the grain can be enumerated as one preferred example.

Meanwhile, for the purpose of controlling to the utmost a sensitivity reduction caused when a pressure is exerted to a light-sensitive material, the grains of a uniform type structure having a small distribution in a halogen composition in the grains are also preferably used in a high silver chloride emulsion having a silver chloride content of 90 mole or more.

The silver halide grain contained in the silver halide emulsion used in the present invention has preferably the average grain size (the grain size is defined by a diameter of a circle having the same area as that of a projected area of the grain and a number average is calculated therefrom) of 0.1 to 2 μm.

In the size distribution of these grains, preferred is a so-called monodispersion in which a fluctuation coefficient (obtained by dividing a standard deviation in the grain size distribution with an average grain size) is 20% or less, preferably 15% or less. The above monodispersed emulsions are preferably used for the same layer in a blend or simultaneously coated for the purpose of obtaining a broad latitude.

The silver bromochloride emulsion used in the present invention can be synthesized by the processes described in "Chemie et Phisique Photographique" written by P. Glafkides (published by Paul Montel Co., Ltd., 1967), "Photographic Emulsion Chemistry" written by G. F. Duffin (published by Focal Press Co., Ltd., 1966), and "Making and Coating Photographic Emulsion" written by V. L. Zelikman (published by Focal Press Co., Ltd., 1964). That is, there may be used any of an acid process, a neutral process and an ammonia process. Any of a single jet process, a double jet process and the combination thereof may be used as a process for reacting a water soluble silver salt with a water soluble halide. There can be used as well a process in which the grains are formed under the presence of excessive silver ions (a so-called reverse mixing process). There can also be used as one form of the double jet process, a process in which pAg of a solution in which the silver halide grains are formed is maintained constant, that is, a so-called controlled double jet process. There can be obtained with this process, the silver halide emulsion having a regular crystal form and an almost uniform grain size.

Various polyvalent metal ion impurities can be introduced into the silver halide emulsion used in the present invention in the course of an emulsion grain formation or a physical ripening. There can be enumerated as the examples of the compounds used, the salts of cadmium, zinc, lead, copper, and thallium, and the salts or the complex salts of iron, ruthenium, rhodium, palladium, osmium, iridium, and platinum which are the VIII Group elements. In particular, the above VIII Group elements can preferably be used. An addition amount of these compounds is spread over a wide range according to the purposes, and it is preferably $10^{-9}$ to $10^{-2}$ mole based on silver halide.

All of the silver halide emulsions used in the present invention are usually subjected to a chemical sensitization and a spectral sensitization.

With respect to the chemical sensitization, there can be used in combination, the chemical sensitization by chalcogen, such as a sulfur sensitization, a selenium sensitization, and a tellurium sensitization, a noble metal sensitization represented by a gold sensitization, and a reduction sensitization. With respect to the compounds used for the chemical sensitization, those described in a right lower column at page 18 to a right upper column at page 22 of JP-A-62-215272 are preferably used.

The spectral sensitization is carried out for the purpose of providing the emulsions contained in the respective layers of the light-sensitive material of the present invention with the spectral sensitivities in the prescribed wavelength regions. In the present invention, it is preferably carried out by adding a dye which absorbs light in a wavelength region corresponding to an aimed spectral sensitivity (sensitizing dye). There can be enumerated as a spectral sensitizing dye used herein, the compounds described in, for example, "Heterocyclic Compounds—Cyanine Dyes and Related Compounds" written by F. M. Harmer (published by John Wiley & Sons, New York, London, 1964). Those described in the right upper column at page 22 to page 38 of above JP-A-62-215272 are preferably used as the concrete examples of the compounds and the spectral sensitizing process.

Various compounds or the precursors thereof can be added to the silver halide emulsion used in the present invention for the purposes of preventing a fog or stabilizing the photographic performances in a production process and during storing or photographic processing. Those described at pages 39 to 72 of above mentioned JP-A-62-215272 are preferably used as the concrete examples of these compounds.

The emulsion used in the present invention is a so-called surface latent image type emulsion in which a latent image is formed primarily on a grain surface.

In the present invention, at least one of the light-sensitive silver halide emulsion layers and the light-insensitive layers can be a coloring layer capable of being decolored by a development processing. In the case where the coloring layer is the light-insensitive layer, it either may contact directly an emulsion layer or may be provided so that it contacts the emulsion layer via an intermediate layer containing gelatin and an anti-color mixing agent such as hydroquinone. This coloring layer is provided preferably below (a support side) the emulsion layer coloring to the same kind of an elementary color as that of the colored color thereof. It is possible either to independently provide all of the coloring layers corresponding to the respective elementary colors or to arbitrarily select only a part thereof to provide it. Further, it is possible as well to provide the coloring layer colored so that it corresponds to a plurality of the elementary color regions. In an optical reflection density in the coloring layer, the optical density value in the wavelength in which the optical density is the highest in a wave-length region used for an exposure (a visible ray region of 400 to 700 nm in case of a usual printer exposure and a wavelength of a scanning exposure light source used in case of a scanning exposure) is 0.2 or more and 3.0 or less, more preferably 0.5 or more and 2.5 or less, and particularly preferably 0.8 or more and 2.0 or less.

The publicly known processes can be applied to form the coloring layer. They include, for example, a process in which a dye is incorporated into a hydrophilic colloid layer in the form of a solid fine particle dispersion as is the case with the dyes described in a right upper column at page 3 to page 8 of JP-A-2-282244 and the dyes described in a right upper column at page 3 to a left lower column at page 11 of JP-A-3-7931, a process in which an anionic dye is mordanted to a cationic polymer, a process in which a dye is adsorbed on a fine particle of silver halide to fix it in a layer, and a process in which colloidal silver is used as described in JP-A-1-239544. There is described at pages 4 to 13 of JP-A-2-308244 as a process in which a fine powder of a dye is dispersed in the form of a solid matter, for example, a process in which there is incorporated a fine powder dye which is substantially insoluble in water at pH 6 or lower but substantially soluble in water at pH 8 or higher. Further, a process in which an anionic dye is mordanted to a cationic polymer is described at pages 18 to 26 of JP-A-2-84637. A process for preparing colloidal silver as a photo-absorbing agent is shown in U.S. Pat. Nos. 2,688,601 and 3,459,563. Of these processes, preferred are the process in which the fine powder dye is incorporated and the process in which colloidal silver is used.

These coloring agents are used preferably in such an amount that the optical reflection density described above can be given.

For the purpose of improving a sharpness of an image, the following means are preferably used for the light-sensitive material according to the present invention in combination with the provision of the coloring layer described above capable of being decolored by a processing. That is, the water-soluble dyes (among them, an oxonol type dye) capable of being decolored by processing, described at pages 27 to 76 of European Patent EP 0,337,490A2 are preferably added to a hydrophilic colloid layer so that an optical reflection density of the light-sensitive material in 680 nm becomes 0.70 or more; titanium oxide which is subjected to a surface treatment with di- to tetrahydric alcohols (for example, trimethylolethane) is preferably incorporated into an anti-water resin layer of a support in a proportion of 12% by weight or more (more preferably 14% by weight or more); and a hydrophilic colloid layer containing a white pigment is preferably provided so that the coated amount thereof becomes 2 $g/m^2$ or more.

In the case where the light-sensitive material according to the present invention is a color light-sensitive material, the respective anti-diffusible cyan, magenta and yellow couplers are preferably incorporated thereinto.

A high boiling organic solvent for a photographic additive such as the cyan, magenta and yellow couplers capable of being used in the present invention is a water immiscible compound having a melting point of 100° C. or lower and a boiling point of 140° C. or higher and can be used as long as it is a good solvent for the couplers. The high boiling organic solvent has preferably the melting point of 80° C. or lower. The high boiling organic solvent has preferably the boiling point of 160° C. or higher, more preferably 170° C. or higher.

The details of these high boiling solvents are described in a right lower column at page 137 to a right upper column at page 144 of JP-A-62-215272.

The cyan, magenta and yellow couplers can be impregnated in a loadable latex polymer (for example, U.S. Pat. No. 4,203,716) or dissolved together with a water insoluble and organic solvent soluble polymer under the presence (or absence) of the organic high boiling solvent described above to emulsify and disperse them in a hydrophilic colloid aqueous solution.

There are preferably used the homopolymers or copolymers described in U.S. Pat. No. 4,857,449 and at pages 12 to 30 of International Patent Publication WO88/00723. A methacrylate series or acrylamide series polymer, particularly the acrylamide series polymer is more preferably used in terms of a stabilization of a dye image.

The color image preservability-improving compounds described in European Patent EP 0,277,589A2 are preferably used for the light-sensitive material according to the present invention together with a coupler. In particular, they are used preferably in combination with a pyrazoloazole coupler and a pyrrolotriazole coupler.

That is, further preferably used simultaneously or singly for preventing the side effects of, for example, a generation of stain due to a reaction of a color developing agent or the oxidation product thereof remained in a layer during a storage after processing with a coupler to produce color developing dye are the compounds which are chemically combined with an aromatic amine series developing agent remained after a color development processing to form a chemically inactive and substantially colorless compound, and/or the compounds which are chemically combined with the oxidation product of an aromatic amine series developing agent remained after the color development processing to form a chemically inactive and substantially colorless compound. The anti-mold agents described in JP-A-63-271247 are preferably added to the light-sensitive material according to the present invention for the purpose of preventing various molds and bacteria which grow in a hydrophilic colloid layer to deteriorate an image.

A paper support coated with polyethylene containing a white pigment is preferably used as a support for the light-sensitive material according to the present invention. In addition thereto, there may be used a white color polyester series support or a support in which a layer containing a white pigment is provided on a support side having a silver halide emulsion layer. Further, an anti-halation layer is preferably provided on a support side coated thereon with a silver halide emulsion layer or the back face thereof in order to improve a sharpness. In particular, a transmission density of a support is settled preferably in the range of 0.35 to 0.8 so that a display can be admired with either a reflected light or a transmitted light.

The light-sensitive material according to the present invention may be exposed with either a visible ray or an infrared ray. An exposing manner may be either a low illuminance exposure or a high illuminance and short time exposure. Particularly in case of the latter, a laser scanning exposing system in which an exposing time per pixel is shorter than $10^{-4}$ second is preferred.

In exposure, the band stop filter described in U.S. Pat. No. 4,880,726 is preferably used, whereby a light mixture is removed to notably improve a color reproduction.

An exposed light-sensitive material is preferably subjected to a bleach-fixing processing after a color development for the purpose of a rapid processing. In particular, in the case where the high silver chloride emulsion described above is used, pH of the bleach-fixing solution is preferably 6.5 or less, more preferably about 6 or less for the purpose of accelerating desilver.

The color developing solution used in the present invention contains more preferably an organic preservative in place of hydroxylamine and a sulfite ion.

Herein, the organic preservative means the whole organic compounds which can reduce a deterioration speed of an aromatic primary amine color developing agent by adding it to a processing solution for a color photographic light-sensitive material. That is, they are the organic compounds having a function to prevent an oxidation of the color developing agent by such as air. Among them, the particularly useful organic preservatives are a hydroxylamine derivative (excluding hydroxylamine), hydroxamic acids, hydrazines, hydrazides, α-amino acids, phenols, α-hydroxyketones, α-aminoketones, sugars, monoamines, diamines, polyamines, quaternary ammonium salts, nitroxy radicals, alcohols, oximes, diamido compounds, and condensed ring amines. These are disclosed in JP-B-48-30496, JP-A-52-143020, 63-4235, 63-30845, 63-21647, 63-44655, 63-44655, 63-53551, 63-43140, 63-56654, 63-58346, 63-43138, 63-146041, 63-44657, and 63-44656, U.S. Pat. No. 3,615,503 and 2,494,903, JP-A-1-97953, 1-186939, 1-186940, 1-187557, and 2-306244, and European Patent Publication EP 0530921A1. In addition thereto, there may be used as the preservative according to necessity, various metals described in JP-A-57-44148 and 57-53749, salicylic acids described in JP-A-59-180588, amines described in JP-A-63-239447, 63-128340, 1-186939, and 1-187557, alkanolamines described in JP-A-54-3532, polyethyleneimines described in 56-94349, and the aromatic polyhydroxy compounds described in U.S. Pat. No. 3,746,544. In particular, preferably added are alkanolamines such as triethanolamine, dialkylhydroxylamine such as N,N-diethylhydroxylamine and N,N-di(sulfoethyl)hydroxylamine, an α-amino acid desrivative such as glycine, alanine, leucine, serine, threonine, valine, and isoleucine, and an aromatic polyhydroxy compound such as sodium catechol-3,5-disulfonate. In particular, the combined use of dialkylhydroxylamine and alkanolamines or the combined use of α-amino acids and alkanolamines represented by glycine and dialkylhydroxylamine described in European Patent Publication EP 0530921A1, respectively, are more preferred in terms of an improvement in a stability of a color developing solution, and, an improvement in a stability in a continuous processing.

An amount having a function to prevent a deterioration of a color developing agent will suffice for an addition amount of these organic preservative. It is preferably 0.01 to 1.0 mole/liter, more preferably 0.03 to 0.30 mole/liter.

Those described in the following patent publications, particularly European Patent EP 0,355,660A2 (JP-A-2-139544) are preferably used as the silver halide emulsions, other materials (additives) and photographic constitutional layers (a layer arrangement) each applied to the light-sensitive material according to the present invention, and the processing processes and the additives for a processing, which are applied for processing this light-sensitive material:

| Photographic elements | JP-A-62-215272 | JP-A-2-33144 | EP 0355660A2 |
|---|---|---|---|
| Silver halide emulsion | pp. 10, right upper colmn, line 6 to pp. 22, left lower colmn, line 5, and pp. 12, right lower colmn, line 4 from bottom to pp. 13, left upper colmn, line 17. | pp. 28, right upper colmn, line 16 to pp. 29, right lower colmn, line 11, and pp. 30, line 2 to 5. | pp. 45, line 53 to pp. 47, line 3, and pp. 47, line 20 to 22. |
| Silver halide solvent | pp. 12, left lower colmn, line 6 to 14, and pp. 13, left upper colmn, line 3 from bottom to pp. 18, left lower colmn, last line. | — | — |
| Chemical sensitizer | pp. 12, left lower colmn, line 3 from bottom to right lower colmn, line 5 from bottom, and pp. 18, right lower colmn, line 1 to pp. 22, right upper colmn, line 9 from bottom. | pp. 29, right lower colmn, line 12 to last line. | pp. 47, line 4 to 9. |
| Spectral sensitizer (spectral sensitizing process) | pp. 22, right upper colmn, line 8 from bottom to pp. 38, last line. | pp. 30, left upper colmn, line 1 to 13. | pp. 47, line 10 to 15. |
| Emulsion stabilizer | pp. 39, left upper colmn, line 1 to pp. 72, right upper colmn, last line. | pp. 30, left upper colmn, line 14 to right upper colmn, line 1. | pp. 47, line 16 to 19. |
| Development accelerator | pp. 72, left lower colmn, line 1 to pp. 91, right upper colmn, line 3. | — | — |
| Color coupler (cyan, magenta and yellow couplers) | pp. 91, right upper colmn, line 4 to pp. 121, left upper colmn, line 6. | pp. 3, right upper colmn, line 14 to pp. 18, left upper colmn, last line, and pp. 30, right upper colmn, line 6 to pp. 35 right lower colmn, line 11. | pp. 4, line 15 to 27, pp. 5, line 30 to pp. 28, last line, pp. 45, line 29 to 31, and pp. 47, line 23 to pp. 63, line. 50 |
| Color forming accelerator | pp. 121, left lower colmn, line 7 to pp. 125, right upper colmn, line 1. | — | — |
| UV absorber | pp. 125, right upper colmn, line 2 to pp. 127, left lower colmn, last line. | pp. 37, right lower colmn, line 14 to pp. 38, left upper colmn, line 11. | pp. 65, line 22 to 31. |
| Anti-fading agent (an image stabilizer) | pp. 127, right lower colmn, line 1 to pp. 137, left lower colmn, line 8. | pp. 36, right upper colmn, line 12 to pp. 37, left upper colmn, line 19. | pp. 4, line 30 to pp. 5, line 23, pp. 29, line 1 to pp. 45, line 25, pp. 45, line 33 to 40, and pp. 65, line 2 to 21. |
| High boiling and/or low boiling organic solvent | pp. 137, left lower colmn, line 9 to pp. 144, right upper, last line. | pp. 35, right lower colmn, line 14 to pp. 36, left upper, line 4. | pp. 64, line 1 to 51. |
| Process for dispersing photographic additives | pp. 144, left lower colmn, line 1 to pp. 146, right upper colmn, line 7. | pp. 27, right lower colmn, line 10 to pp. 28, left upper, last line, and pp. 35, right lower colmn, line 12 to pp. 36, right upper colmn, line 7. | pp. 63, line 51 to pp. 64, line 56. |
| Hardener | pp. 146, right upper colmn, line 8 to pp. 155, left lower colmn, line 4. | — | — |
| Precursor of | pp. 155, left lower colmn, | — | — |

-continued

| Photographic elements | JP-A-62-215272 | JP-A-2-33144 | EP 0355660A2 |
|---|---|---|---|
| a developing agent | line 5 to right lower colmn, line 2. | | |
| Development inhibitor-releasing compound | pp. 155, right lower colmn, line 3 to 9. | — | — |
| Support | pp. 155, right lower colmn, line 19 to pp. 156, left upper colmn, line 14. | pp. 38, right upper colmn, line 18 to pp. 39, left upper colmn, line 3. | pp. 66, line 29 to pp. 67 line 13. |
| Light-sensitive layer structure | pp. 156, left upper colmn, line 15 to right lower colmn, line 14. | pp. 28, right upper colmn, line 1 to 15. | pp. 45, line 41 to 52 |
| Dye | pp. 156, right lower colmn, line 15 to pp. 184, right lower colmn, last line. | pp. 38, left upper colmn, line 12 to right upper colmn, line 7. | pp. 66, line 18 to 22. |
| Anti-color mixing agent | pp. 185, left upper colmn, line 1 to pp. 188, right lower colmn, line 3. | pp. 36, right upper colmn, line 8 to 11. | pp. 64, line 57 to pp. 65 line 1. |
| Gradation controller | pp. 188, right lower colmn, line 4 to 8. | — | — |
| Anti-stain agent | pp. 188, right lower colmn, line 9 to pp. 193, right lower colmn, line 10. | pp. 37, left upper colmn, last line to right lower colmn, line 13. | pp. 65, line 32 to pp. 66, line 17. |
| Surface active agent | pp. 201, left lower colmn, line 1 to pp. 210, right upper colmn, last line | pp. 18, right upper colmn, line 1 to pp. 24, right lower colmn, last line, and pp. 27, left lower colmn, line 10 from bottom to right lower colmn, line 9. | — |
| Fluorinated compound (anti-static agent, coating aid, lubricant and anti-adhesion agent) | pp. 210, left lower colmn, line 1 to pp. 222, left lower colmn, line 5. | pp. 25, left upper colmn, line 1 to pp. 27, right upper colmn, line 9. | — |
| Binder (hydrophilic colloid) | pp. 222, left lower colmn, line 6 to pp. 225, left upper colmn, last line | pp. 38, right upper colmn, line 8 to 18. | pp. 66, line 23 to 28. |
| Thickener | pp. 225, right upper colmn, line 1 to pp. 227, right upper colmn, line 2. | — | — |
| Anti-static agent | pp. 227, right upper colmn, line 3 to pp. 230, left upper colmn, line 1. | — | — |
| Polymer latex | pp. 230, left upper colmn, line 2 to pp. 239, last line | — | — |
| Matting agent | pp. 240, left upper colmn, line 1 to right upper colmn, last line. | — | — |
| Photographic processing method (processing steps and additives) | pp. 3, right upper colmn, line 7 to pp. 10, right upper colmn, line 5. | pp. 39, left upper colmn, line 4 to pp. 42, left upper colmn, last line. | pp. 67, line 14 to pp. 69, line 28. |

Remarks:
1. The content amended according to the Amendment of March 16, 1987 is included in the cited items of JP-A-62-215272.
2. Of the above color couplers, also preferably used as a yellow coupler are the so-called short wave type yellow couplers described in JP-A-63-231451, 63-123047, 63-241547, 1-173499, 1-213648, and 1-250944.

In addition to the diphenylimidazole series cyan couplers described in JP-A-2-33144, preferably used as a cyan coupler are the 3-hydroxypyridine series cyan couplers described in European Patent EP 0333185A2 (of them, particularly preferred are the coupler prepared by providing the tetra-equivalent coupler (42) exemplified as the concrete example with a chlorine splitting group to convert it to a divalent coupler, and the couplers (6) and (9)), and the cyclic active methylene series cyan couplers (of them, particularly preferred are the couplers 3, 8 and 34 which are exemplified as the concrete example), described in JP-A-64-32260, the pyrrolopyrazole type cyan couplers described in European Patent EP 0456226A1, the pyrroloimidazole type cyan couplers described in European Patent EP 0484909, and the pyrrolotriazole type cyan couplers described in European Patents EP 0488248 and EP 0491197A1. Of them, the pyrrolotriazole type cyan couplers are particularly preferably used.

In addition to the compounds described in the above tables, preferably used as the yellow coupler are the acylacetoamide type yellow couplers having an acyl group with a 3- to 5-membered cyclic structure, described in European Patent EP 0447969A1, the malondianilide type yellow couplers having a cyclic structure, described in European Patent EP 0482552A1, and the acylacetoamide type yellow couplers having a dioxane structure, described in U.S. Pat. No. 5,118,599. Of them, particularly preferably used are the acylacetoamide type yellow coupler in which the acyl group is a 1-alkylcyclopropane- 1-carbonyl group, and the malondianilide type yellow coupler in which one of anilides constitutes an indoline ring. These couplers can be used singly or in combination.

There can be used as the magenta coupler used in the present invention, the 5-pyrazolone series magenta couplers and pyrazoloazole series magenta couplers described in the publicly known literatures shown in the above tables. Of them, preferably used in terms of the stability of a hue and an image stability and a color development performance are the pyrazolotriazole couplers in which a secondary or tertiary alkyl group is connected directly to a 2-, 3- or 6-position of a pyrazolotriazole ring, described in JP-A-61-65245, the pyrazoloazole couplers containing a sulfonamide group in the molecule, described in JP-A-61-65246, the pyrazoloazole couplers having an alkoxyphenylsulfonamide ballast group, described in JP-A-61-147254, and the pyrazoloazole couplers having an alkoxy group or aryloxy group at a 6-position, described in European Patents 226,849A and 294,785A.

In addition to the processes described in the above tables, preferred as the processing process for the color light-sensitive material of the present invention are the processing materials and processing processes described on the 1st line of a right lower column at page 26 to the 9th line of a right upper column at page 34 of JP-A-2-207250, and on the 17th line of a left upper column at page 5 to the 20th line of a right lower column at page 18 of JP-A-4-97355.

EXAMPLES

The examples of the present invention will be shown below but the present invention is not limited thereto.

EXAMPLE 1

A silver halide emulsion was prepared in the following manner. The grain size of the silver halide grains contained in the respective emulsions was represented by using a volumetric-weighted mean volume measured by coal tar counter method and a diameter of a circle having the same area as a projected area of a grain, which was obtained from an electron microscopic photograph. A fluctuation coefficient in a grain size distribution was obtained by aid of the latter. Further, a number-average surface area of an emulsion grain and a number-average ratio of a (111) plane sharing therein were obtained from the electron microscopic photograph.

Preparation of the silver bromochloride emulsion C0:

Sodium chloride 6.4 g was added to a 3 weight % aqueous solution 1600 ml of lime-treated gelatin and N,N'-dimethylimidazolidine- 2-thione (1 weight % aqueous solution) 3.2 ml was added thereto. An aqueous solution containing silver nitrate 0.2 mole and an aqueous solution containing potassium bromide 0.08 mole and sodium chloride 0.12 mole were added and mixed in this solution at 52° C. while vigorously stirring.

Subsequently, an aqueous solution containing silver nitrate 0.8 mole and an aqueous solution containing potassium bromide 0.32 mole, sodium chloride 0.48 mole and potassium hexachloroiridate (IV) 0.05 mg were added and mixed at 52° C. while vigorously stirring. After maintaining at 52° C. for 10 minutes, desalting and washing with water were carried out. Further, lime-treated gelatin 90.0 g was added and then a sulfur sensitizer and a gold sensitizer were added to provide an optimum chemical sensitization at 50° C.

Thus, there was prepared the silver bromochloride emulsion C0 (comprising the silver halide grains of a cubic grain, an average grain size [a diameter of a circle having the same area as a projected area of a grain] of 0.56 μm, a volumetric-weighted average volume of 0.13 $\mu m^3$, a fluctuation coefficient in a grain size distribution of 0.08, and silver bromide of 40 mole %).

Preparation of the silver bromochloride emulsion C1:

Sodium chloride 17.6 g was added to a 3 weight % aqueous solution 1600 ml of lime-treated gelatin, and an aqueous solution containing silver nitrate 0.094 mole and an aqueous solution containing sodium chloride 0.12 mole were added and mixed in this solution at 56° C. while vigorously stirring. Subsequently, an aqueous solution containing silver nitrate 0.85 mole and an aqueous solution containing sodium chloride 1.15 mole were added and mixed at 56° C. while vigorously stirring. Thereafter, desalting in which settling and washing were carried out at 40° C. was carried out. Further, lime-treated gelatin 90.0 g was added. A silver bromide fine grain emulsion having the grain size of 0.05 μm was added to this emulsion at 50° C. in the amount of 0.005 mole in terms of a silver amount to form a silver bromide-rich domain (phase) on the surface of a silver chloride host grain, and then a sulfur sensitizer and a gold sensitizer were added to provide an optimum chemical sensitization at 50° C. Potassium hexachloroiridate (IV) was incorporated in advance into the silver bromide fine grains in the amount of 0.8 mg per 0.005 mole of the silver bromide fine grain.

Thus, there was prepared the silver bromochloride emulsion C1 (comprising the silver halide grains of a cubic grain, an average grain size [a diameter of a circle having the same area as a projected area of a grain]: 0.56 μm, a volumetric weighted average volume of 0.13 $\mu m^3$, a fluctuation coefficient in a grain size distribution of 0.09, and silver bromide 0.53 mole % localized at a part of a grain surface and the remainder: silver chloride).

Preparation of the silver bromochloride emulsion C2:

The silver bromochloride emulsion C2 was prepared in the same manner as that in the silver bromochloride emulsion C1, except that an aqueous solution containing silver nitrate 0.094 mole and an aqueous solution containing sodium chloride 0.12 mole were added and mixed at 58° C. while vigorously stirring and then the compound II-11 0.27 g was added and that further, a silver nitrate aqueous solution and a silver chloride aqueous solution were added and mixed at 58° C.

Thus, there was prepared the silver bromochloride emulsion C2 (comprising the silver halide grains of a tetradecahedral grain, a volumetric-weighted average volume of 0.13 $\mu m^3$, a fluctuation coefficient in a grain size distribution of 0.09, and silver bromide 0.53 mole % localized at a part of a grain surface and the remainder: silver chloride).

Preparation of the silver bromochloride emulsion C3:

The silver bromochloride emulsion C3 was prepared in the same manner as that in the silver bromochloride emulsion C1, except that an aqueous solution containing silver nitrate 0.094 mole and an aqueous solution containing sodium chloride 0.12 mole were added and mixed at 58° C. while vigorously stirring and then the compound II-11 0.32 g was added and that further, a silver nitrate aqueous solution and a silver chloride aqueous solution were added and mixed at 58° C.

Thus, there was prepared the silver bromochloride emulsion C3 (comprising the silver halide grains of a tetradecahedral grain, a volumetric-weighted average volume of 0.13 $\mu m^3$, a fluctuation coefficient in a grain size distribution of 0.09, and silver bromide 0.53 mole % localized at a part of a grain surface and the remainder: silver chloride).

Preparation of the silver bromochloride emulsion C4:

The silver bromochloride emulsion C4 was prepared in the same manner as that in the silver bromochloride emulsion C1, except that an aqueous solution containing silver nitrate 0.094 mole and an aqueous solution containing sodium chloride 0.12 mole were added and mixed at 58° C. while vigorously stirring and then the compound II-11 0.37 g was added and that further, a silver nitrate aqueous solution and a silver chloride aqueous solution were added and mixed at 58° C.

Thus, there was prepared the silver bromochloride emulsion C4 (comprising the silver halide grains of a tetradecahedral grain, a volumetric-weighted average volume of 0.13 $\mu m^3$, a fluctuation coefficient in a grain size distribution of 0.10, and silver bromide 0.53 mole % localized at a part of a grain surface and the remainder: silver chloride).

Preparation of the silver bromochloride emulsion C5:

The silver bromochloride emulsion C5 was prepared in the same manner as that in the silver bromochloride emulsion C1, except that an aqueous solution containing silver nitrate 0.094 mole and an aqueous solution containing sodium chloride 0.12 mole were added and mixed at 58° C. while vigorously stirring and then the compound II-11 0.43 g was added and that further, a silver nitrate aqueous solution and a silver chloride aqueous solution were added and mixed at 58° C.

Thus, there was prepared the silver bromochloride emulsion C5 (comprising the silver halide grains of an octahedral grain, a volumetric-weighted average volume of 0.13 $\mu m^3$, a fluctuation coefficient in a grain size distribution of 0.10, and silver bromide 0.53 mole % localized at a part of a grain surface and the remainder: silver chloride).

Preparation of the silver bromochloride emulsion C6:

The silver bromochloride emulsion C6 was prepared in the same manner as that in the silver bromochloride emulsion C5, except that the compound II-24 0.34 g was added.

Thus, there was prepared the silver bromochloride emulsion C6 (comprising the silver halide grains of an octahedral grain, a volumetric-weighted average volume of 0.13 $\mu m^3$, a fluctuation coefficient in a grain size distribution of 0.10, and silver bromide 0.53 mole % localized at a part of a grain surface and the remainder: silver chloride).

Preparation of the silver bromochloride emulsion C7:

The silver bromochloride emulsion C7 was prepared in the same manner as that in the silver bromochloride emulsion C5, except that the compound IV-10.38 g was added.

Thus, there was prepared the silver bromochloride emulsion C7 (comprising the silver halide grains of an octahedral grain, a volumetric-weighted average volume of 0.13 $\mu m^3$, a fluctuation coefficient in a grain size distribution of 0.10, and silver bromide 0.53 mole % localized at a part of a grain surface and the remainder: silver chloride).

Preparation of the silver bromochloride emulsion C8:

The silver bromochloride emulsion C8 was prepared in the same manner as that in the silver bromochloride emulsion C5, except that the compound V-7 2.0 g was added.

Thus, there was prepared the silver bromochloride emulsion C8 (comprising the silver halide grains of an octahedral grain, a volumetric-weighted average volume of 0.13 $\mu m^3$, a fluctuation coefficient in a grain size distribution of 0.10, and silver bromide 0.53 mole % localized at a part of a grain surface and the remainder: silver chloride).

Preparation of the silver bromochloride emulsion C9:

The silver bromochloride emulsion C9 was prepared in the same manner as that in the silver bromochloride emulsion C1, except that sodium chloride 17.6 g was added to a 3 weight aqueous solution 1600 ml of lime-treated gelatin and further, the compound II-11 0.63 g was added and that after an aqueous solution containing silver nitrate 0.094 mole and an aqueous solution containing sodium chloride 0.12 mole were added and mixed at 58° C. while vigorously stirring, a silver nitrate aqueous solution and a silver chloride aqueous solution were further added and mixed at 58° C.

Thus, there was prepared the silver bromochloride emulsion C9 (comprising the silver halide grains of a tabular grain, a volumetric-weighted average volume of 0.13 $\mu m^3$, an aspect ratio of 5.2, a fluctuation coefficient in a grain size distribution of 0.22, and silver bromide 0.53 mole % localized at a part of a grain surface and the remainder: silver chloride).

The emulsions C0 to C9 obtained in the manners described above are summarized in the following Table 1.

TABLE 1

| Emulsion No. | Grain formation temperature (°C.) | Added compound Kind | Amount (g) | Grain form | Side length (μm) | Surface area ($\mu m^2$) | Average volume ($\mu m^3$) | (111) plane ratio (%) |
|---|---|---|---|---|---|---|---|---|
| C0 | 52 | — | | Cube | 0.50 | 1.5 | 0.087 | 0 |
| C1 | 56 | — | | Cube | 0.50 | 1.5 | 0.13 | 0 |
| C2 | 58 | II-11 | 0.27 | Tetradecahedron | — | 1.6 | 0.13 | 35 |
| C3 | 58 | II-11 | 0.32 | Tetradecahedron | — | 1.5 | 0.12 | 50 |
| C4 | 58 | II-11 | 0.37 | Tetradecahedron | — | 1.5 | 0.12 | 70 |
| C5 | 58 | II-11 | 0.43 | Octahedron | — | 1.4 | 0.13 | 100 |
| C6 | 58 | II-24 | 0.34 | Octahedron | — | 1.4 | 0.13 | 100 |
| C7 | 58 | IV-1 | 0.38 | Octahedron | — | 1.4 | 0.13 | 100 |
| C8 | 58 | V-7 | 2.0 | Octahedron | — | 1.4 | 0.13 | 100 |
| C9 | 58 | II-11 | 0.63 | Plate | — | 1.7 | 0.13 | 100 |

These emulsions were used as a red-sensitive emulsion to prepare a multilayer color light-sensitive material.

After the surface of a paper support laminated on the both sides thereof with polyethylene was subjected to a corona discharge treatment, a gelatin subbing layer containing sodium dodecylbenzenesulfonate was provided. Further, various photographic constitutional layers were coated thereon to prepare the multilayer color photographic paper (101) having the layer structure shown below. The coating solutions were prepared in the following manner.

Preparation of the first layer-coating solution

The yellow coupler (ExY-1) 153.0 g, the dye image stabilizer (Cpd-1) 15.0 g, the dye image stabilizer (Cpd-2) 7.5 g, and the dye image stabilizer (Cpd-3) 16.0 g were dissolved in the solvent (Solv-1) 25 g, the solvent (Solv-2) 25 g and ethyl acetate 180.0 ml, and this solution was emulsified and dispersed in a 10 % gelatin aqueous solution 1000 g containing a 10 % sodium dodecylbenzenesulfonate aqueous solution 60 ml and citric acid 10 g to thereby prepare the emulsified dispersion A.

On the other hand, there was prepared the silver bromochloride emulsion A (cube, the 3:7 mixture (silver mole ratio) of a large size emulsion A with an average grain size of 0.88 μm and a small size emulsion A with an average grain size of 0.70 μm, wherein the fluctuation coefficients in the grain size distributions were 0.08 and 0.10, respectively, and either size emulsions contained silver bromide 0.3 mol % localized at a part of a surface of a grain comprising basically silver chloride).

The blue-sensitive sensitizing dyes A and B shown below were added to this emulsion in the amounts of each $2.0\times10^{-4}$ mole per mole of silver to the large size emulsion A and each $2.5\times10^{-4}$ mole per mole of silver to the small size emulsion A. Then, this emulsion was subjected to a chemical sensitization by adding a sulfur sensitizer and a gold sensitizer.

The following spectral sensitizing dyes were used for the silver bromochloride emulsions contained in the respective light-sensitive emulsion layers:

Blue-sensitive emulsion layer:

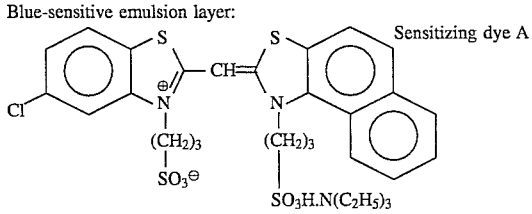

and

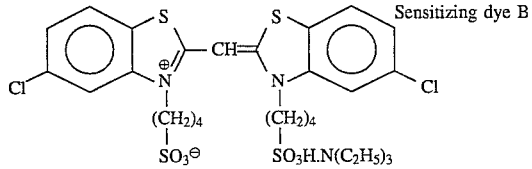

(each $2.0\times10^{-4}$ mole per mole of silver halide to the large size emulsion and each $2.5\times10^{-4}$ mole per mole of silver halide to the small size emulsion).

Green-sensitive emulsion layer:

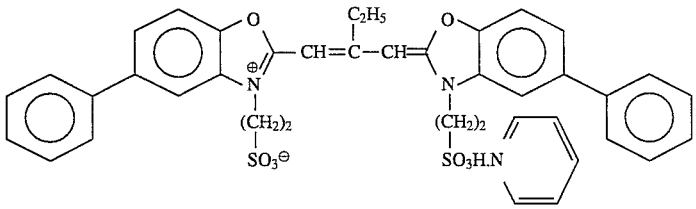

The foregoing emulsified dispersion A and this silver bromochloride emulsion A were mixed and dissolved, whereby the first layer-coating solution was prepared so that it was of a composition shown below. An emulsion coated amount is represented in terms of a coated amount converted to a silver amount.

The coating solutions for the second layer to the seventh layer were prepared as well in the same manner as that in the first layer-coating solution. Sodium 1-oxy-3,5-dichloro-s-triazine was used as a gelatin hardener for the respective layers.

Further, Cpd-14 and Cpd-15 were added to the respective layers so that the whole amounts thereof became 25.0 mg/m$^2$ and 50.0 mg/m$^2$, respectively.

($4.0\times10^{-4}$ mole per mole of silver halide to the large size emulsion and $5.6\times10^{-4}$ mole per mole of silver halide to the small size emulsion) and

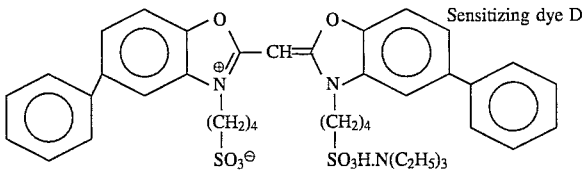

($7.0\times10^{-5}$ mole per mole of silver halide to the large size emulsion and $1.0\times10^{-4}$ mole per mole of silver halide to the small size emulsion).

Red-sensitive emulsion layer:

Sensitizing dye E

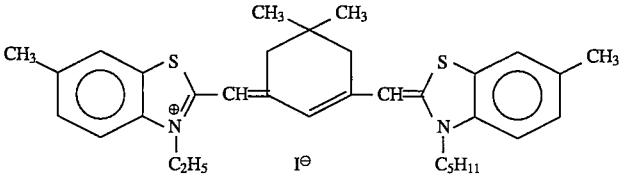

($0.9\times10^{-4}$ mole per mole of silver halide)

Further, the following compound was added to the red-sensitive layer in the amount of $2.6\times10^{-3}$ mole per mole of silver halide:

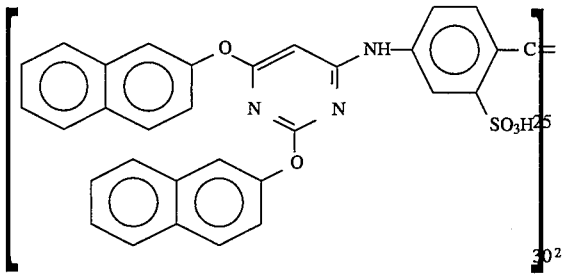

Further, 1-(5-methylureidophenyl)-5-mercaptotetrazole was added to the blue-sensitive emulsion layer, the green-sensitive emulsion layer and the red-sensitive emulsion layer in the amounts of $8.5\times10^{-3}$ mole, $7.7\times10^{-4}$ mole and $2.5\times10^{-4}$ mole per mole of silver halide, respectively.

Further, 4-hydroxy-6-methyl-1,3,3a,7-tetrazaindene was added to the blue-sensitive emulsion layer and the green-sensitive emulsion layer in the amounts of $1\times10^{-4}$ mole and $2\times10^{-4}$ mole per mole of silver halide, respectively.

Further, the following dyes (a coated amount was shown in a parenthesis) were added to the emulsion layers for preventing irradiation.

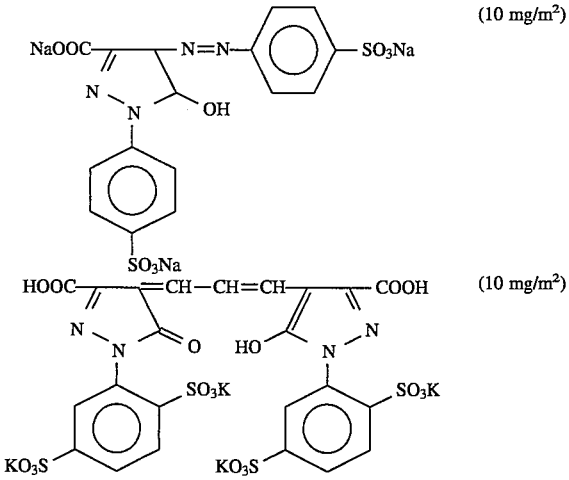

(10 mg/m²)

(10 mg/m²)

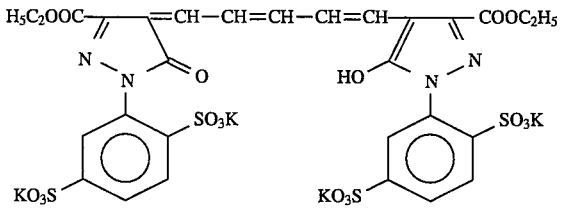

(40 mg/m²)

and

-continued

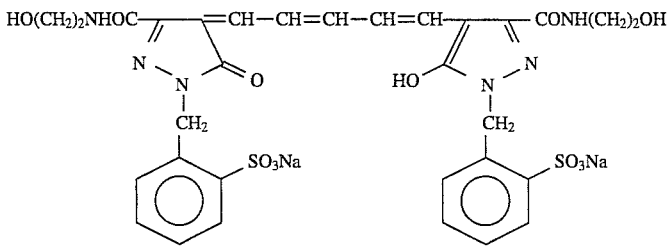

(20 mg/m²)

Layer constitution:

The compositions of the respective layers are shown below. The numerals represent the coated amounts (g/m²). The coated amounts of the silver halide emulsions are expressed in terms of the amounts converted to silver.

| | |
|---|---|
| Support: | |
| Polyethylene-laminated paper [polyethylene coated on the 1st layer side contains a white pigment (titanium oxide) and a blue dye (ultramarine)]. | |
| First layer (a blue-sensitive emulsion layer): | |
| Above silver bromochloride emulsion A | 0.27 |
| Gelatin | 1.36 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.13 |
| Solvent (Solv-2) | 0.13 |
| Second layer (an anti-color mixing layer): | |
| Gelatin | 1.00 |
| Anti-color mixing agent (Cpd-4) | 0.06 |
| Solvent (Solv-2) | 0.25 |
| Solvent (Solv-3) | 0.25 |
| Solvent (Solv-7) | 0.03 |
| Third layer (a green-sensitive emulsion layer): | |
| Silver bromochloride emulsion (cube, 1:3 mixture (Ag mole ratio) of the large size emulsion B having an average grain size of 0.55 μm and the small size emulsion B having an average grain size of 0.39 μm, wherein the fluctuation coefficients in the grain size distributions were 0.10 and 0.08, respectively, and either size emulsions contained silver bromide of 0.8 mol % localized at a part of a surface of the grain comprising basically silver chloride) | 0.13 |
| Gelatin | 1.45 |
| Magenta coupler (ExM) | 0.16 |
| Dye image stabilizer (Cpd-2) | 0.03 |
| Dye image stabilizer (Cpd-5) | 0.15 |
| Dye image stabilizer (Cpd-6) | 0.01 |
| Dye image stabilizer (Cpd-7) | 0.01 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer (an anti-color mixing layer): | |
| Gelatin | 0.70 |
| Anti-color mixing agent (Cpd-4) | 0.04 |
| Solvent (Solv-2) | 0.18 |
| Solvent (Solv-3) | 0.18 |
| Solvent (Solv-7) | 0.02 |
| Fifth layer (a red-sensitive emulsion layer): | |
| Silver bromochloride emulsion (C0 described above) | 0.20 |
| Gelatin | 0.85 |

-continued

| | |
|---|---|
| Cyan coupler (ExC) | 0.33 |
| UV absorber (UV-2) | 0.18 |
| Dye image stabilizer (Cpd-1) | 0.33 |
| Dye image stabilizer (Cpd-6) | 0.01 |
| Dye image stabilizer (Cpd-8) | 0.01 |
| Dye image stabilizer (Cpd-9) | 0.01 |
| Dye image stabilizer (Cpd-10) | 0.01 |
| Dye image stabilizer (Cpd-11) | 0.01 |
| Solvent (Solv-1) | 0.01 |
| Solvent (Solv-6) | 0.22 |
| Sixth layer (a UV absorbing layer): | |
| Gelatin | 0.55 |
| UV absorber (UV-1) | 0.38 |
| Dye image stabilizer (Cpd-5) | 0.02 |
| Dye image stabilizer (Cpd-12) | 0.15 |
| Seventh layer (a protective layer): | |
| Gelatin | 1.13 |
| Acryl-modified copolymer of polyvinyl alcohol (a modification degree: 17%) | 0.05 |
| Liquid paraffin | 0.02 |
| Surface active agent (Cpd-13) | 0.01 |

(ExY) Yellow coupler

1:1 Mixture (mole ratio) of:

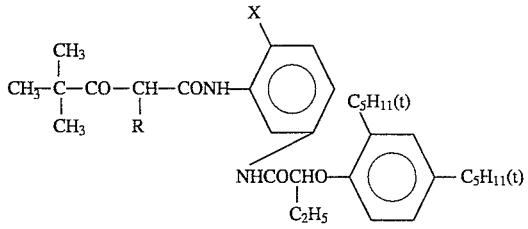

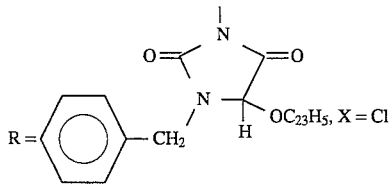

and

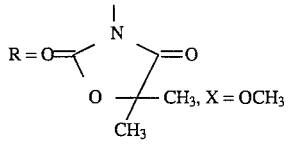

(ExM) Magenta coupler

-continued

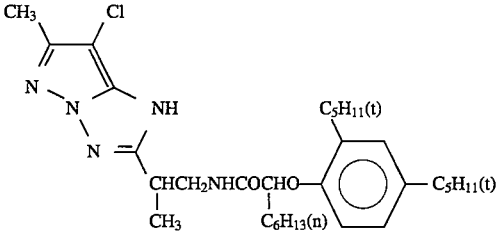

(ExC) Cyan coupler
3:7 mixture (mole ratio of

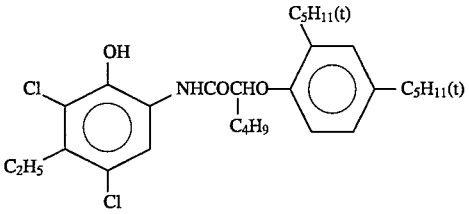

and

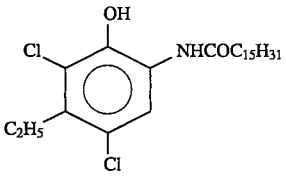

(Cpd-1) Dye image stabilizer

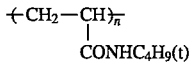

average molecular weight: 60,000
(Cpd-2) Dye image stabilizer

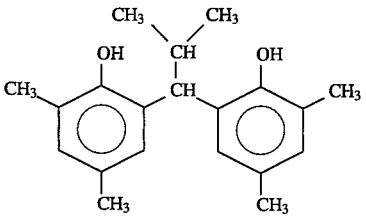

(Cpd-3) Dye image stabilizer

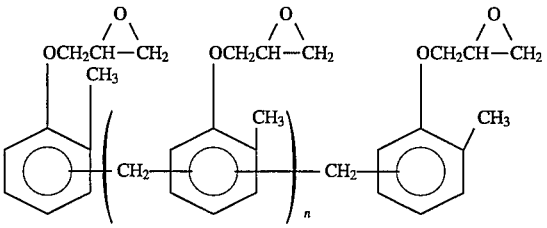

n = 7 to 8 (average value)
(Cpd-4) Anti-color mixing agent

-continued

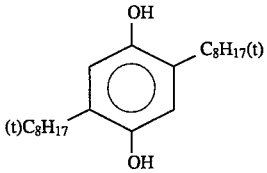

(Cpd-5) Dye image stabilizer

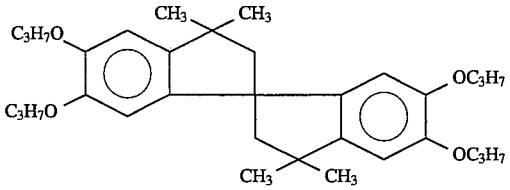

(Cpd-6) Dye image stabilizer

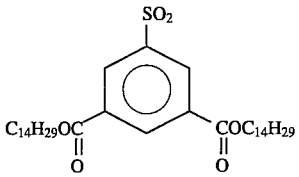

(Cpd-7) Dye image stabilizer

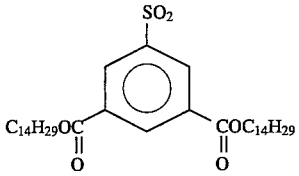

(Cpd-8) Dye image stabilizer

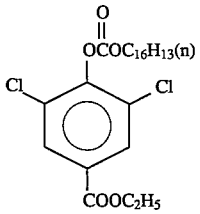

(Cpd-9) Dye image stabilizer

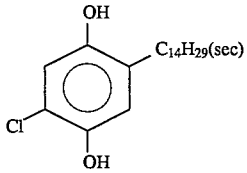

(Cpd-10) Dye image stabilizer

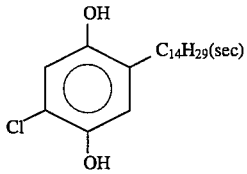

(Cpd-11) Dye image stabilizer

-continued
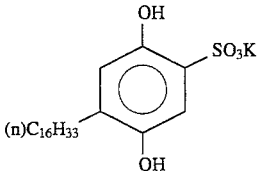
(Cpd-12) Dye image stabilizer
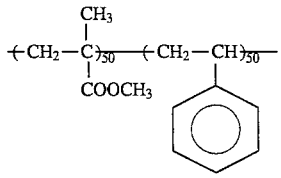
average molecular weight: 60,000
(Cpd-13) Surface active agent
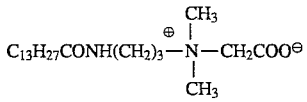
(Cpd-14) Preservative
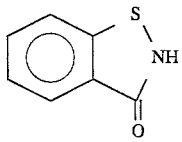
(Cpd-15) Preservative
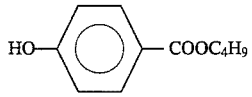
(UV-1) UV absorber
1:5:10:5 mixture (weight ratio) of:
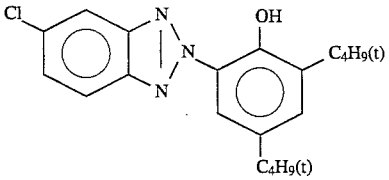
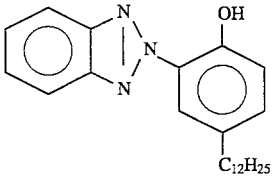
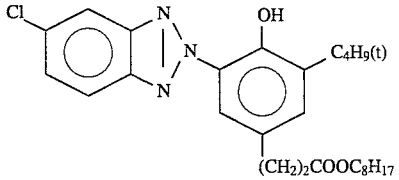
-continued
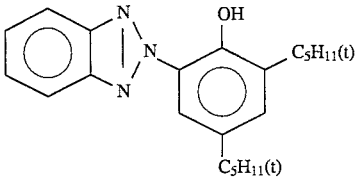
(UV-2) UV absorber
1:2:2 mixture (weight ratio) of:
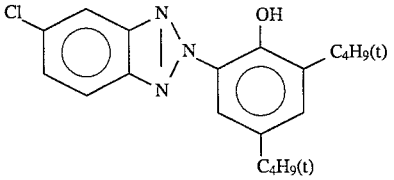
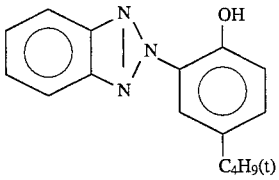
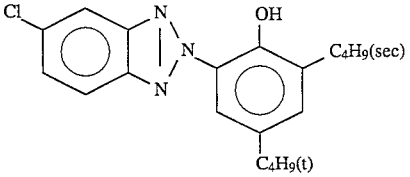
(Solv-1) Solvent
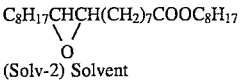
(Solv-2) Solvent
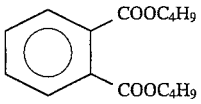
(Solv-3) Solvent
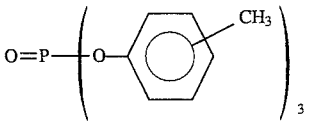
(Solv-4) Solvent
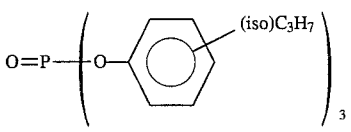
(Solv-5) Solvent
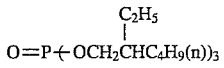
(Solv-6) Solvent -continued

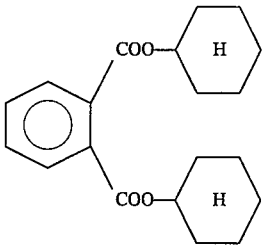

(Solv-7) Solvent

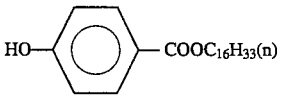

The light-sensitive materials were prepared in the same manner as that in Sample 101 thus obtained, except that the silver halide emulsion contained in the red-sensitive layer was changed from C0 to C1 to C9. They were designated as Samples to 110.

Next, ten kinds of the light-sensitive materials were prepared in the same manners as those in Samples 101 to 110, except that the anti-color mixing agent (Cpd-4) used in the anti-color mixing layers of the second layer and the fourth layer was replaced with an equimolar amount of the following compound. They were designated as Samples 111 to 120.

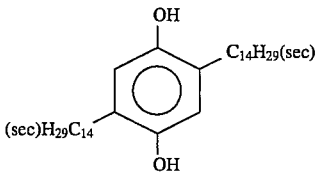

(i)

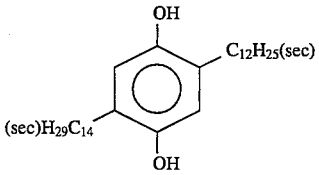

(ii)

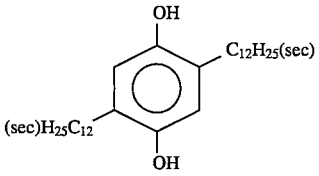

(iii)

[mixture of (i), (ii) and (iii) by 1:2:1 (mole ratio)]

These coated samples were used to test the performances of the emulsions prepared.

Each sample was subjected to an exposure with a sensitometer (FWH type manufactured by Fuji Photo Film Co., Ltd.) via a red filter (SP-3 manufactured by Fuji Photo Film Co., Ltd.) with optical wedge for 0.1 second at 250 CMS, and 60 seconds after exposing, the sample was subjected to a color development processing with the processing solutions and processing processes shown below, wherein a rapid processability was compared at two points of 20 seconds and 45 seconds in a developing time for the evaluation thereof.

A reflection density of the sample thus processed was measured to obtain a so-called characteristic curve. A fog density, a relative sensitivity and a contrast were obtained from these characteristic curves. The relative sensitivity was expressed by a value relative to the sensitivity of Sample 101, which was set at 100, wherein the sensitivity was defined by a reciprocal of an exposure amount giving a density higher by 0.5 than a fog density. A contrast was expressed by an increase in a developing density obtained when an exposure was increased by 0.5 log E from the point where the sensitivity was obtained.

Next, after an exposure at the same condition as that in an exposure for the sensitometry described above was carried out for the purpose of checking a fluctuation in a photographic performance by a change in a passing time from exposing to processing, the samples which were subjected to a development processing by changing a time passed until the development to 40 minutes and 240 minutes. After the respective samples were measured for a reflection density, a developing density corresponding to an exposure giving a density higher by 1.0 than fog was obtained in the sample processed 60 seconds after the exposing to set it for an index for a fluctuation in a photographic performance.

These results are shown in Table 2.

TABLE 2

| | Development Processing Performance 60 Seconds After Exposing | | | | | | | |
|---|---|---|---|---|---|---|---|---|
| | 20 seconds development | | | 45 seconds development | | | Aging change after exposing | |
| Sample | Fog | S | C | Fog | S | C | 40 min. | 240 min. |
| 101 (Comp.) | 0.08 | 56 | 0.75 | 0.09 | 100 | 1.32 | +0.01 | +0.02 |
| 102 (Comp.) | 0.12 | 81 | 1.39 | 0.14 | 109 | 1.56 | +0.02 | +0.03 |
| 103 (Comp.) | 0.12 | 79 | 1.37 | 0.13 | 104 | 1.55 | +0.01 | −0.03 |
| 104 (Comp.) | 0.10 | 88 | 1.36 | 0.10 | 118 | 1.57 | −0.06 | −0.09 |
| 105 (Comp.) | 0.09 | 96 | 1.38 | 0.10 | 127 | 1.58 | −0.07 | −0.13 |
| 106 (Comp.) | 0.09 | 98 | 1.37 | 0.10 | 130 | 1.57 | −0.08 | −0.14 |
| 107 (Comp.) | 0.08 | 94 | 1.32 | 0.09 | 124 | 1.53 | −0.07 | −0.13 |
| 108 (Comp.) | 0.09 | 92 | 1.29 | 0.10 | 121 | 1.52 | −0.06 | −0.12 |
| 109 (Comp.) | 0.09 | 98 | 1.33 | 0.10 | 128 | 1.56 | −0.08 | −0.13 |
| 110 (Comp.) | 0.08 | 103 | 1.25 | 0.09 | 135 | 1.40 | −0.09 | −0.14 |
| 111 (Comp.) | 0.08 | 54 | 0.73 | 0.09 | 101 | 1.31 | +0.02 | +0.03 |
| 112 (Comp.) | 0.13 | 83 | 1.37 | 0.15 | 112 | 1.55 | +0.03 | +0.04 |
| 113 (Comp.) | 0.12 | 81 | 1.38 | 0.13 | 107 | 1.53 | +0.03 | +0.01 |
| 114 (Inv.) | 0.11 | 89 | 1.36 | 0.10 | 120 | 1.55 | +0.01 | −0.02 |
| 115 (Inv.) | 0.09 | 97 | 1.35 | 0.11 | 131 | 1.56 | −0.01 | −0.03 |
| 116 (Inv.) | 0.09 | 101 | 1.37 | 0.10 | 133 | 1.56 | −0.02 | −0.04 |
| 117 (Inv.) | 0.09 | 98 | 1.34 | 0.10 | 125 | 1.52 | −0.01 | −0.03 |
| 118 (Inv.) | 0.08 | 95 | 1.31 | 0.09 | 121 | 1.51 | −0.02 | −0.03 |
| 119 (Inv.) | 0.09 | 102 | 1.33 | 0.10 | 129 | 1.54 | −0.03 | −0.02 |
| 120 | 0.09 | 105 | 1.26 | 0.09 | 136 | 1.41 | −0.03 | −0.03 |

TABLE 2-continued (Inv.)

Note -
S: Sensitivity
C: Contrast

| Processing step | Temperature | Time |
|---|---|---|
| Color developing | 35° C. | 20 seconds<br>45 seconds |
| Bleach/fixing | 35° C. | 45 seconds |
| Rinsing (1) | 30 to 35° C. | 20 seconds |
| Rinsing (2) | 30 to 35° C. | 20 seconds |
| Rinsing (3) | 30 to 35° C. | 20 seconds |
| Rinsing (4) | 30 to 35° C. | 30 seconds |
| Drying | 70 to 80° C. | 60 seconds |
| (Rinsing was of a three tanks countercurrent system from (4) to (1)). | | |

The compositions of the respective processing solutions are as follows:

| Color developing solution: | |
|---|---|
| Water | 800 ml |
| Ethylenediamine-N,N,N',N'-tetramethylenephosphonic acid | 1.5 g |
| Potassium bromide | 0.015 g |
| Triethanolamine | 8.0 g |
| Sodium chloride | 1.4 g |
| Potassium carbonate | 25.0 g |
| N-ethyl-N-(β-methanesulfon-amidethyl)-3-methyl-4-aminoaniline sulfate2 | 5.0 g |
| N,N-bis(carboxymethyl) hydrazine | 4.0 g |
| Sodium N,N-di(sulfoethyl)hydroxylamine | 4.2 g |
| Fluorescent whitening agent (Whitex 4B manufactured by Sumitomo Chem. Ind.) | 1.0 g |
| Water was added to | 1000 ml |
| pH (25° C.) | 10.10 |
| **Bleach/fixing solution:** | |
| Water | 400 ml |
| Ammonium thiosulfate (700 g/liter) | 100 ml |
| Sodium sulfite | 17.0 g |
| Iron (III) ammonium ethylenediamine-tetraacetate | 55.0 g |
| Disodium ethylenediaminetetracetate | 5.0 g |
| Ammonium bromide | 40.0 g |
| Glacial acetic acid | 6.0 g |
| Water was added to | 1000 ml |
| pH (25° C.) | 6.00 |
| **Rinsing solution:** | |
| Ion-exchanged water (contents of calcium and magnesium: each 3 ppm or lower) | |

As apparent from the results, while fog is low in Sample 101 in which the emulsion C0 having a silver bromide content of 40% is used, a development is slow and therefore it is not suited to a rapid development. An improvement in a developing speed is observed in Sample 102 using the cubic emulsion C1 having a silver chloride content of 99.47% and Sample 103 using the tetradecahedral emulsion C2 but fog is a little high. In Samples 104 to 110 using the emulsions C3 to C9 for which any of the compounds of the present invention represented by Formulas (II) to (V) was used in a grain formation to raise a (111) plane ratio to 50% or more, a marked increase in a sensitivity as well as a decrease in fog is observed. However, a developing density has notably been lowered by aging from exposing to developing (a latent image fading is noticeable).

On the contrary, in Samples 114 to 120 using the compounds of the present invention represented by Formula (I) in combination with the emulsions having the high (111) plane ratio, it can be found that the latent image fading is improved without deteriorating a sensitivity.

EXAMPLE 2

The multilayer color light-sensitive materials were prepared in the same manner as that in Sample 106 prepared in Example 1, except that the anti-color mixing agent (Cpd-4) used for the anti-color mixing layers of the second layer and the fourth layer was replaced with the equimolar amount of SV-1, SV-4, SV-17, and SV-9 each described above and compounds shown below. They were designated as Samples 121 to 126.

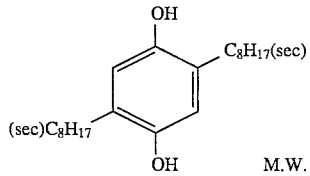

M.W. = 334.6

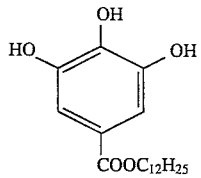

M.W. = 338.4

These samples were subjected to a development and a test in the same manners as those in Example 1 to evaluate the performances thereof. Provided that a sensitivity was expressed by a value relative to a sensitivity of Sample 106 obtained with the development for 45 seconds, which was set at 100.

The results obtained are shown in Table 3.

TABLE 3

| | 20 seconds development | | | 45 seconds development | | | Aging change after exposing | |
|---|---|---|---|---|---|---|---|---|
| Sample | Fog | S | C | Fog | S | C | 40 min. | 240 min. |
| 106 (Comp.) | 0.09 | 75 | 1.37 | 0.10 | 100 | 1.57 | −0.08 | −0.14 |
| 121 (Comp.) | 0.09 | 73 | 1.35 | 0.10 | 99 | 1.56 | −0.07 | −0.13 |
| 122 (Comp.) | 0.09 | 72 | 1.31 | 0.10 | 101 | 1.56 | −0.09 | −0.14 |
| 123 (Inv.) | 0.09 | 79 | 1.39 | 0.10 | 105 | 1.57 | −0.01 | −0.02 |
| 124 (Inv.) | 0.09 | 37 | 1.38 | 0.11 | 106 | 1.58 | −0.02 | −0.03 |
| 125 (Inv.) | 0.09 | 81 | 1.35 | 0.10 | 105 | 1.57 | −0.01 | −0.02 |
| 126 (Inv.) | 0.09 | 76 | 1.33 | 0.10 | 102 | 1.55 | −0.03 | −0.05 |

Note -
S: Sensitivity
C: Contrast

The comparison of Samples 124 to 126 with Samples 06, 121 and 122 shows that the sensitivity is high and a change by aging after exposing is markedly small in Samples 124 to 126 using the silver halide emulsions of the present invention in combination with the anti-color mixing agents of the present invention.

EXAMPLE 3

The light-sensitive materials prepared in Example 1 were used to carry out a test in the following processing steps and processing solutions to confirm that the effects of the present invention were notable as well in the light-sensitive materials of the present invention.

| Processing step | Temperature | Time | Replenishing amount | Tank capacity |
|---|---|---|---|---|
| Color developing | 35° C. | 20 seconds & 45 seconds | 161 ml | 17 l |
| Bleach/fixing | 35° C. | 45 seconds | 215 ml | 17 l |
| Stanbilizing (1) | 35° C. | 20 seconds | — | 10 l |
| Stabilizing (2) | 35° C. | 20 seconds | — | 10 l |
| Stabilizing (3) | 35° C. | 20 seconds | — | 10 l |
| Stabilizing (4) | 35° C. | 20 seconds | 248 ml | |
| Drying | 80° C. | 60 seconds | | |

*Replenishing amount is per $m^2$ of the light-sensitive material.
*The stabilizing step is of a four tank countercurrent system from (4) to (1).

The compositions of the respective processing solutions are as follows:

| Color developing solution | Tank solution | Replenishing solution |
|---|---|---|
| Water | 800 ml | 800 ml |
| Poly(lithium styrenesulfonate) solution (30%) | 0.25 ml | 0.25 ml |
| 1-Hydroxyethylidene-1,1-diphosphonic acid (60%) | 0.8 ml | 0.8 ml |
| Lithium sulfate (anhydrous) | 2.7 g | 2.7 g |
| Triethanolamine | 8.0 g | 8.0 g |
| Sodium chloride | 1.8 g | — |
| Potassium bromide | 0.03 g | 0.025 g |
| Diethylhydroxylamine | 4.6 g | 7.2 g |
| Glycine | 5.2 g | 8.1 g |
| Threonine | 4.1 g | 6.4 g |
| Potassium carbonate | 27 g | 27 g |
| Potassium sulfite | 0.1 g | 0.2 g |
| N-ethyl-N-(β-methanesulfonamidethyl)-3-methyl-4-aminoaniline 3/2 sulfate monohydrate | 4.5 g | 7.3 g |
| Fluorescent whitening agent (4,4'-diaminostilbene series) | 2.0 g | 3.0 g |
| Water was added to | 1000 ml | 1000 ml |
| pH (adjusted with potassium hydroxide and sulfuric acid) | 10.12 | 10.70 |

Bleach/fixing solution (common to the tank solution and the replenishing solution)

| | |
|---|---|
| Water | 400 ml |
| Ammonium thiosulfate (700 g/liter) | 100 ml |
| Sodium sulfite | 17 g |
| Iron (III) ammonium ethylenediaminetetraacetate | 55 g |
| Disodium ethylenediaminetetracetate | 5 g |
| Glacial acetic acid | 9 g |
| Water was added to | 1000 ml |
| pH (25° C.) (adjusted with acetic acid and aqueous ammonia) | 5.40 |

Stabilizing solution (common to the tank solution and replenishing solution)

| | |
|---|---|
| 1,2-Benzoisothiazoline-3-one | 0.02 g |
| Polyvinyl pyrrolidone | 0.05 g |
| Water was added to | 1000 ml |

-continued

| Color developing solution | Tank solution | Replenishing solution |
|---|---|---|
| pH | | 7.0 |

The present invention provides a silver halide photographic light-sensitive material which is capable of a rapid processing and exerts a high sensitivity and low fog, and in which a change in an aging time after exposing and before processing provides less performance fluctuation and an excellent stability.

What is claimed is:

1. A silver halide photographic light-sensitive material comprising a support and provided thereon at least one light-sensitive silver halide emulsion layer and at least one light-insensitive layer, wherein at least one of said light-sensitive emulsion layers contains a silver halide grain emulsion which comprises silver bromochloride having a silver chloride content of 90% or more or silver chloride each containing substantially no silver iodide and in which 50% or more of a grain surface consists of a (111) plane; and further, at least one of said non-light-sensitive layers contains a compound represented by the following Formula (I):

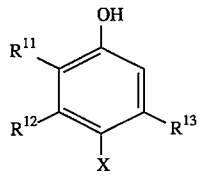

(I)

wherein X represents a hydrogen atom, a hydroxyl group, an amino group, or a sulfonamido group; $R^{11}$ and $R^{12}$ are selected from the group consisting of the same group as that defined for X, an alkyl group, an aryl group, an amido group, a ureido group, an alkylthio group, an arylthio group, an alkoxy group, and an aryloxy group, and $R^{11}$ may form a carbon ring or a heterocyle together with $R_{12}$; when X is a hydrogen atom, $R^{11}$ represents a hydroxyl group, an amino group, or a sulfonamido group; $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group; and the compound represented by Formula (I) has a molecular weight of 390 or more.

2. A silver halide photographic light-sensitive material as claimed in claim 1, wherein said silver halide grain emulsion in which 50% or more of a grain surface consists of a (111) plane is prepared under the presence of at least one of the compounds represented by the following Formula (II), (III), (IV) or (V):

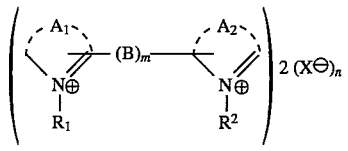

(II)

-continued

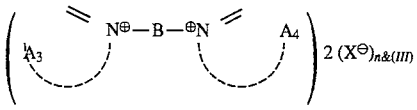

wherein $A_1$, $A_2$, $A_3$, and $A_4$ represent a group of non-metal atoms necessary to complete a nitrogen-containing heterocycle and may be the same or different each other; B represents a divalent linkage group; m represents 0 or 1; $R_1$ and $R_2$ each represent an alkyl group; X represents an anion; and n represents 0 or 1 and when an intramolecular salt is formed, n is 0:

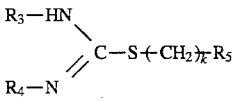

(IV)

wherein $R_3$ and $R_4$ each represent a hydrogen atom, an aryl group, or an aralkyl group, and $R_3$ and $R_4$ may be the same or different; $R_5$ represents an amino group, a sulfonic acid group, or a carboxyl group; and k represents an integer of 1 to 5:

$$X—L^1—(S—L^2)_p—X_qZ \quad (v)$$

wherein X represents an unsubstitited or alkyl-substituted amino group, a quaternary alkylammonium group or a carboxyl group; $L^1$ and $L^2$ each represent a divalent organic group composed of at least one of the groups selected from the group consisting of an alkylene group, an alkenylene group, —$SO_2$—, —SO—, —O—, —CO—, and —N(R)—, in which R represents a hydrogen atom, an alkyl group, an aryl group or —$L^3$—$(S—L^4)_p$—X, and $L^3$ and $L^4$ each represent an alkylene group, an alkenylene group, —$SO_2$—, —SO—, —O— or —CO—; p represents an integer of 1 to 5; q represents an integer of 0 to 3 and is the same as a number of the quaternary alkylammonium group; Z represents an anion; when two or more of —S—$L^2$ group are present in formula (V), two or more of $L^2$ may be the same or different from each other; and two groups represented by X in formula (V) may be the same or different each other.

3. A silver halide photogrphic light-sensitive material as claimed in claim 2, wherein the compounds are those represented by Formula (II), (III) or (IV).

4. A silver halide photographic light-sensitive material as claimed in claim 2, wherein the compounds are those represented by Formula (II) or (III).

5. A silver halide photographic light-sensitive material as claimed in claim 4, wherein in Formula (II) or (III), $A_1$, $A_2$, $A_3$ and A4 each represent a substituted or unsubstituted 5- and 6-membered nitrogen-containing heterocycle; B represents an alkylene group, an arylene group, an alkenylene group, —$SO_2$—, —SO—, —O—, —S—, —CO— or —$NR_3$—, in which $R_3$ represents an alkyl group, an aryl group a hydrogen atom, or a combination thereof; and $R_1$ and $R_2$ each represent a substituted or unsubstituted alkyl group having 1 to 20 carbon atoms.

6. A silver halide photographic light-sensitive material as claimed in claim 2, wherein in Formula (IV), $R_3$ and $R_4$ each are a hydrogen atom or a phenyl group; $R_5$ represents an unsubstituted amino group or a methyl-substituted amino group.

7. A silver halide photographic light-sensitive material as claimed in claim 2, wherein in Formula (IV), X represents an amino group which may be substituted with an unsubstituted or substituted alkyl group; $L^1$ and $L^2$ each represent a divalent organic group constituted singly from an alkylene group which may be substituted, O—, —CO—, —N(R)— or those constituted by combining them.

8. A silver halide photographic light-sensitive material as claimed in claim 1, wherein the compound represented by the Formula (I) has a molecular weight of 430 or more.

9. A silver halide photographic light-sensitive material as claimed in claim 1, wherein the compound represented by the Formula (I) is that represented by the following Formula (VI);

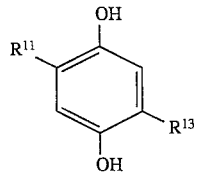

(VI)

wherein $R^{11}$ represents a hydrogen atom, a hydroxyl group, an amino group, or a sulfonamido group, an alkyl group, an aryl group, an amido group, a ureido group, an alkylthio group, an arylthio group, an alkoxy group or an aryloxy group; $R^{13}$ represents a hydrogen atom, a halogen atom, a sulfo group, a carboxyl group, an alkyl group, an acyl group, an oxycarbonyl group, a carbamoyl group, a sulfonyl group, or a sulfamoyl group; and the compound has a molecular weight of 390 or more.

10. A silver halide photographic light-sensitive material as claimed in claim 1, wherein the compound represented by Formula (I) is used in an amount of $1\times10^{-5}$ to $1\times10^{-2}$ mole/$m^2$.

11. A silver halide photographic light-sensitive material as claimed in claim 1, wherein said silver halide grain emulsion is silver bromochloride having a silver chloride content of 95 mole % or more or silver chloride, which contains substantially no silver iodide.

12. A silver halide photographic light-sensitive material as claimed in claim 1, wherein the compound represented by Formula (II), (III), (IV) or (V) is added in an amount of $1\times10^{-6}$ to $1\times10^{-1}$ mole per mole of silver halide.

13. A silver halide photographic light-sensitive material as claimed in claim 1, wherein 80% or more of said grain surface consists of a (111) plane.

14. A silver halide photographic light-sensitive material as claimed in claim 1, wherein said silver halide emulsion grain has a silver bromide rich phase layer or non-layer in an inside of a silver halide grain and/or on a surface thereof.

* * * * *